US010490960B1

(12) United States Patent
Wu

(10) Patent No.: US 10,490,960 B1
(45) Date of Patent: Nov. 26, 2019

(54) FIELD TERMINATION NETWORK PLUG

(71) Applicant: HSING CHAU INDUSTRIAL CO., LTD., Taipei (TW)

(72) Inventor: Kei-Wei Wu, Taipei (TW)

(73) Assignee: HSING CHAU INDUSTRIAL CO., LTD., Taipei (TW)

( * ) Notice: Subject to any disclaimer, the term of this patent is extended or adjusted under 35 U.S.C. 154(b) by 0 days.

(21) Appl. No.: 16/124,218

(22) Filed: Sep. 7, 2018

(51) Int. Cl.

| | |
|---|---|
| ***H01R 4/2433*** | (2018.01) |
| ***H01R 24/64*** | (2011.01) |
| ***H01R 13/50*** | (2006.01) |
| ***H01R 4/242*** | (2018.01) |
| ***H01R 13/506*** | (2006.01) |
| ***H01R 13/66*** | (2006.01) |
| ***H01R 13/424*** | (2006.01) |
| ***H01R 13/58*** | (2006.01) |
| *H01R 107/00* | (2006.01) |

(52) U.S. Cl.
CPC ..... *H01R 24/64* (2013.01); *H01R 4/242* (2013.01); *H01R 4/2433* (2013.01); *H01R 13/424* (2013.01); *H01R 13/501* (2013.01); *H01R 13/506* (2013.01); *H01R 13/58* (2013.01); *H01R 13/665* (2013.01); *H01R 2107/00* (2013.01); *H01R 2201/04* (2013.01)

(58) Field of Classification Search
CPC ..... H01R 4/24; H01R 4/2429; H01R 4/2433; H01R 13/501; H01R 13/506; H01R 13/58; H01R 24/64; H01R 2201/04
See application file for complete search history.

(56) References Cited

U.S. PATENT DOCUMENTS

| | | | | |
|---|---|---|---|---|
| 7,559,790 | B2 * | 7/2009 | Boeck | H01R 24/64 439/409 |
| 7,572,140 | B2 * | 8/2009 | Szelag | H01R 4/2433 439/405 |
| 8,257,117 | B2 | 9/2012 | Pepe et al. | |
| 8,298,922 | B2 * | 10/2012 | Schumann | H01R 13/5829 438/467 |
| 9,799,982 | B1 * | 10/2017 | Lin | H01R 4/2429 |
| 9,819,124 | B2 | 11/2017 | Oberski et al. | |
| 9,929,480 | B1 * | 3/2018 | Wu | H01R 9/031 |
| 10,224,675 | B2 * | 3/2019 | Lin | H01R 4/2429 |

* cited by examiner

*Primary Examiner* — Vanessa Girardi
(74) *Attorney, Agent, or Firm* — Schmeiser, Olsen & Watts, LLP

(57) ABSTRACT

A field termination plug includes a contact retainer, a plug housing, a terminal connection unit, and a cover pivotally connectable to the plug housing. The plug housing includes a front portion and an accommodation portion. The terminal connection unit has contacts and piercing terminals electrically coupled to the respective contacts. When the plug housing carries the terminal connection unit and the contact retainer is attached to the front portion, the contacts are disposed on the front portion for electrical coupling to a network jack and the piercing terminals are disposed upward on the accommodation portion. When the cover is pivoted to an open position, the piercing terminals are exposed for disposition of a wire organizer for attachment of the wires. The cover pivoted to a closed position presses the wire organizer such that the wires attached to the wire organizer are terminated to the respective piercing terminals.

17 Claims, 25 Drawing Sheets

FIELD TERMINATION NETWORK PLUG

FIELD OF THE INVENTION

The present disclosure relates to a network connector, and more particularly, to a field termination plug used in network connectivity.

BACKGROUND OF THE INVENTION

Along with the prevalence of internet of things (IoT) devices, more and more modular plug terminated links (MPTL) have been deployed in zone cabling. In many cases, MPTL is deployed to support power over Ethernet (PoE) application. In this application, the twisted pairs of network cable, usually 23AWG solid cable, is installed on a patch panel at one end, a modular plug at the other end. The modular plug end is made to plug into a WiFi or surveillance device.

By the time that Category 5e (Cat. 5e) or Category 6 (Cat. 6) cabling took the majority in the market, a conventional RJ-45 modular plug having 8 holes each with about 1.10 mm width is suitable for insertion of 4-pair of twisted wires of a cable compliant with Category 5e or 6 having a wire diameter less than 1.10 mm.

However, the needs for higher transmission speed never stop. Nowadays Category 6A cabling predominates in the market. The transmission speed of Category 6A cabling is 10 times higher (10 Gbps/sec) than that of Category 6. In addition, the Category 6A cable is bigger than Category 6 one, for the reason to offer good signal strength in higher frequency. The wire diameter for screened Category 6A solid cable is approximately 1.50 mm. Accordingly, it is reluctantly to insert 8×1.50 mm wires into 8×1.10 mm holes in a conventional modular plug.

Since a good assembly between a conventional RJ-45 plug and cable requires a number of techniques, it is inconvenient for an installer to assemble a conventional RJ-45 plug with cable in the field, such as a telecommunication room, data center, and so on. Hence, in most cases, installers would have modular plugs assembled with cables in advance, i.e., obtaining cable assemblies directly from manufacturing factories which are capable of making sophisticated cable assemblies. However, in reality, sometimes the cabling length is to be decided in the field and cable assembly is still needed in the field.

Thus, there is still room for providing a plug that is convenient for an installer to attach a cable to the plug.

SUMMARY

According to embodiments of the present disclosure, a field termination plug is provided for termination of a plurality of wires of a cable and connection to a network jack. The field termination plug includes a contact retainer, a plug housing, a terminal connection unit, and a cover. The plug housing includes a front portion and an accommodation portion. The front portion has a first opening for attachment of the contact retainer to the front portion. The accommodation portion has a second opening. The terminal connection unit has a plurality of contacts and a plurality of piercing terminals electrically coupled to the respective contacts. When the terminal connection unit is carried by the plug housing and the contact retainer is attached to the front portion, the contacts are disposed on the front portion for electrical coupling to the network jack and the piercing terminals are disposed upward on the accommodation portion. The cover is pivotally connectable to the plug housing. When the cover is pivoted to an open position, the piercing terminals of the terminal connection unit carried by the plug housing are exposed in the second opening in order for a wire organizer for attachment of the wires to be disposed on the piercing terminals. When the cover is pivoted to a closed position, the cover presses the wire organizer such that the wires attached to the wire organizer are terminated to the respective piercing terminals.

In some embodiments, the terminal connection unit may include two opposite lateral sides and an inner side perpendicular to the two lateral sides; the piercing terminals include a first group of piercing terminals, a second group of piercing terminals, and a third group of piercing terminals; the first group of piercing terminals is disposed adjacent to the inner side, the second group of piercing terminals is disposed adjacent to one of the lateral sides, and the third group of piercing terminals is disposed adjacent to another one of the lateral sides.

In some embodiments, the first group of piercing terminals are capable of terminating four of the wires, the second group of piercing terminals are capable of terminating another two of the wires, and the third group of piercing terminals are capable of terminating yet another two of the wires.

In some embodiments, the terminal connection unit may further have a first guiding element disposed between the contacts and the first group of piercing terminals.

In some embodiments, the first guiding element may have a top section; the front portion of the plug housing may have a bearing section; the bearing section and the top section form a bearing for pivotal connection between the cover and the plug housing when the terminal connection unit is carried by the plug housing.

In some embodiments, the wire organizer further may have a second guiding element for engaging with the first guiding element.

In some embodiments, the cover may include a protection portion and a pivot section. The protection portion has a plurality of lateral sides and a plurality of grooves along the lateral sides. The pivot section, extending from the protection portion, is used for being pivotally engaged with the plug housing.

In some embodiments, the field termination plug may further include a detachable latch. The detachable latch is utilized for detachably engaging with the grooves and for moving along a traveling path defined by the grooves when the cover is pivoted from the closed position to the open position, the detachable latch including a front arm, engaging arms for engaging with the grooves and a rear member extending from the front arm and the engaging arms.

In some embodiments, the contact retainer may further have a plug lever; and the front arm is used for depressing the plug lever when the front arm is pivoted toward the plug lever with respect to the engaging arms, while the cover is in the closed position and the detachable latch is positioned at a first end of the traveling path, so as to permit release of the field termination plug from the network jack.

In an embodiment, the detachable latch is capable of being detached from the cover when the detachable latch is positioned at a second end of the traveling path so as to prevent depression of the plug lever as the field termination plug being connected to the network jack.

In some embodiments, the field termination plug may further include a strain relief device. The strain relief device includes a receiving portion and a securing portion. The receiving portion is used for receiving the cable. The securing portion extends from the receiving portion and is utilized for detachably securing to the plug housing and the cover when the cover is in the closed position.

In some embodiments, the receiving portion has a tapering hole passing through the receiving portion for retaining the cable, the receiving portion includes an inner end and an outer end, the tapering hole has an inner opening at the inner end tapering to an outer opening at the outer end, wherein the securing portion extends from the inner end of the receiving portion.

In some embodiments, the receiving portion is used for receiving the cable without truncation when the cable has a size smaller than or equal to that of the outer opening.

In some embodiments, the receiving portion is capable of being truncated to fit the cable when the cable has a size greater than that of the outer opening and smaller than or equal to that of the inner opening.

In some embodiments, the receiving portion includes an outer surface between the inner end and the outer end; and an indicator disposed on the outer surface to indicate a position for truncation of the receiving portion for a specific cable size.

In some embodiments, the plug housing includes a front housing and a rear housing. The front housing includes the front portion and the accommodation portion. The rear housing is utilized for being attached to the front housing so as to cover at least one side of the terminal connection unit carried by the front housing. The securing portion includes a plurality of securing elements for detachably securing to the rear housing and the cover when the cover is in the closed position.

In some embodiments, the terminal connection unit includes an insulation base, a circuit board, and a terminal connection housing. The circuit board is disposed on the insulation base, wherein the contacts and the piercing terminals are disposed on the circuit board. The terminal connection housing is utilized for covering the circuit board partially, wherein the first guiding element is disposed on the terminal connection housing and the terminal connection housing has openings through which the piercing terminals are exposed at least partially.

In an embodiment, the insulation base has a first securing arm which is resilient and for engaging with an interior sidewall of the accommodation portion of the front housing so as to secure the insulation base to the front housing.

According to further embodiments of the present disclosure, a strain relief device is provided for a communication plug, such as the above field termination plug. The strain relief device includes a receiving portion and a securing portion. The receiving portion is used for receiving the cable. The securing portion extends from the receiving portion and is utilized for detachably securing to a plug housing of the communication plug. The receiving portion has a tapering hole passing through the receiving portion for retaining a cable. The receiving portion includes an inner end and an outer end. The tapering hole has an inner opening at the inner end tapering to an outer opening at the outer end, wherein the securing portion extends from the inner end of the receiving portion.

In some embodiments, the receiving portion is used for receiving the cable without truncation when the cable has a size smaller than or equal to that of the outer opening.

In some embodiments, the receiving portion is capable of being truncated to fit the cable when the cable has a size greater than that of the outer opening and smaller than or equal to that of the inner opening.

In some embodiments, the receiving portion includes an outer surface between the inner end and the outer end; and an indicator disposed on the outer surface to indicate a position for truncation of the receiving portion for a specific cable size.

In some embodiments, a field termination plug is provided for termination of a plurality of wires of a cable and connection to a network jack. The field termination plug includes a contact retainer, a plug housing, a terminal connection unit, and a cover. The plug housing includes a front portion having a first opening for attachment of the contact retainer to the front portion; and an accommodation portion having a second opening. The terminal connection unit includes a plurality of contacts, a plurality of piercing terminals electrically coupled to the respective contacts, and two opposite lateral sides and an inner side perpendicular to the two lateral sides. When the terminal connection unit is carried by the plug housing and the contact retainer is attached to the front portion, the contacts are disposed on the front portion for electrical coupling to the network jack and the piercing terminals are disposed upward on the accommodation portion, the piercing terminals including a first group of piercing terminals disposed adjacent to the inner side, a second group of piercing terminals disposed adjacent to one of the lateral sides, and a third group of piercing terminals disposed adjacent to another one of the lateral sides. The cover is pivotally connectable to the plug housing. When the cover is pivoted to an open position, the piercing terminals of the terminal connection unit carried by the plug housing are exposed in the second opening in order for a wire organizer for attachment of the wires to be disposed on the piercing terminals; when the cover is pivoted to a closed position, the cover presses the wire organizer such that the wires attached to the wire organizer are terminated to the respective piercing terminals.

In some embodiments, a field termination plug is provided for termination of a plurality of wires of a cable and connection to a network jack. The field termination plug includes a contact retainer, a plug housing, and a terminal connection unit. The plug housing includes a front portion having a first opening for attachment of the contact retainer to the front portion, and an accommodation portion having a second opening. The terminal connection unit has a plurality of contacts and a plurality of piercing terminals electrically coupled to the respective contacts. When the terminal connection unit is carried by the plug housing and the contact retainer is attached to the front portion, the contacts are disposed on the front portion for electrical coupling to the network jack and the piercing terminals are disposed upward on the accommodation portion. The cover is pivotally connectable to the plug housing. When the cover is pivoted to an open position, the piercing terminals of the terminal connection unit carried by the plug housing are exposed in the second opening in order for attachment of the wires to be disposed on the piercing terminals.

In some embodiments, a wire organizer is provided and has a plurality of wire-receiving slots for attachment of the wires to the wire organizer. The wire organizer is capable of being disposed on the terminal connection unit carried by the plug housing when the cover is in the open position.

BRIEF DESCRIPTION OF THE DRAWINGS

The embodiments of the present disclosure can be best understood by referring to the following detailed description of the preferred embodiments and the accompanying drawings, wherein.

DETAILED DESCRIPTION OF THE PREFERRED EMBODIMENTS

Various embodiments of the disclosure with reference to the appended drawings are now explained. While numerous details are set forth, it is understood that some embodiments of the disclosure may be practiced without these details. In other instances, well-known circuits, structures, and techniques have not been shown in detail so as not to obscure the understanding of this description. In addition, all of the embodiments may be combined in any way to provide additional embodiments.

Referring to FIGS. 1 to 6, a field termination plug is illustrated according to some embodiments of the disclosure. As shown in FIGS. 1 to 4, a field termination plug 1 is provided for termination of a plurality of wires 91 of a cable 90. The field termination plug 1 with the cable 90 terminated thereto can be then connected to a network jack, for example, a single jack on a wall, a patch panel, or any type of jacks of a network equipment, such as a network switch shown in FIG. 7, and so on.

Figure 1:
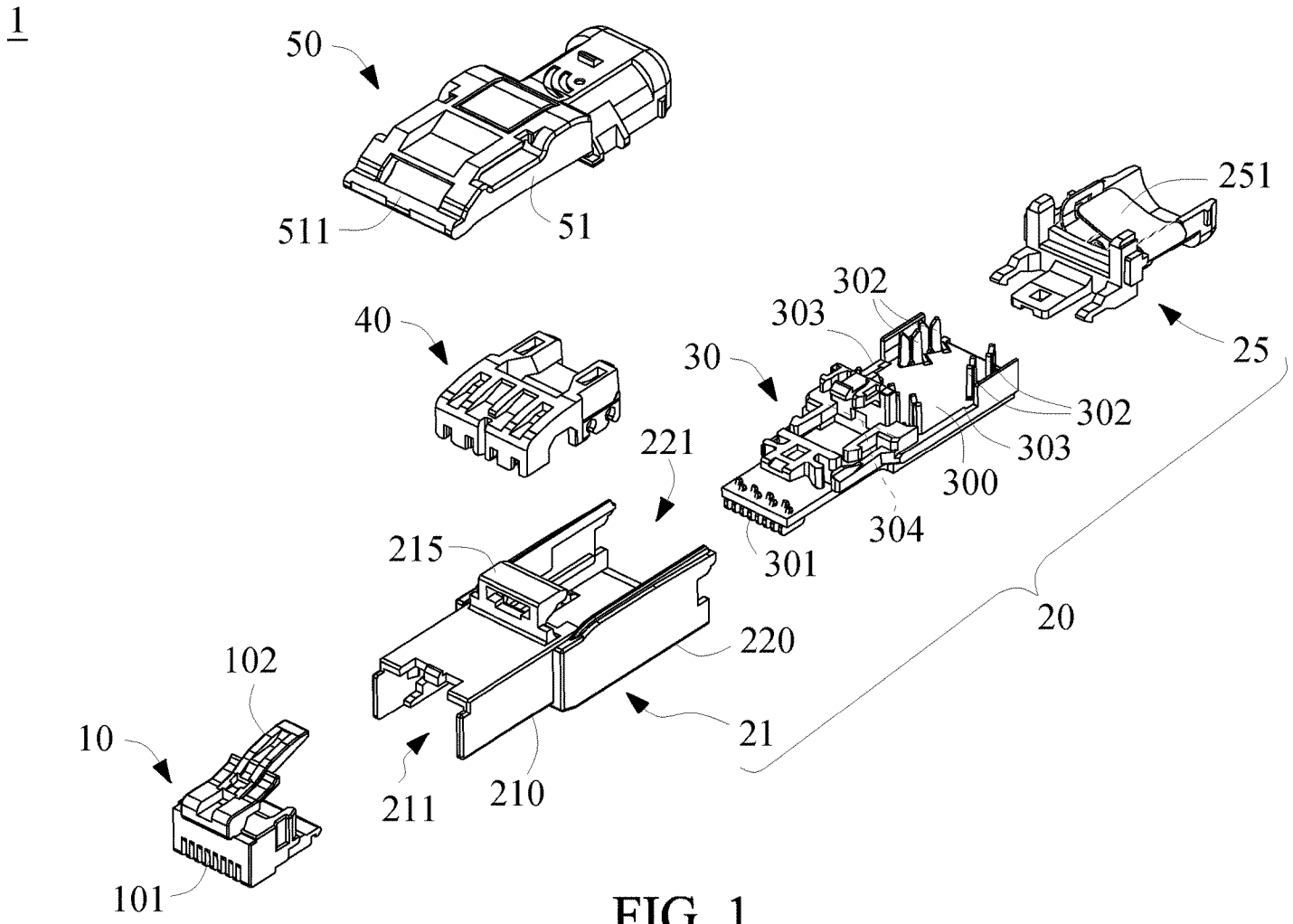
FIG. 1 is an exploded view of a field termination plug according to an embodiment of the disclosure.

As illustrated in the exploded view of FIG. 1, the field termination plug 1 includes a contact retainer 10, a plug housing 20, a terminal connection unit 30, and a cover 50.

The contact retainer 10 has a plurality of contact slots 101 and a plug lever 102.

The plug housing 20 includes a front portion 210 and an accommodation portion 220. The front portion 210 has a first opening 211 for attachment of the contact retainer 10 to the front portion 210. The accommodation portion 220 has a second opening 221 for carrying the terminal connection unit 30. For example, the accommodation portion 220 may be constructed for insertion of the terminal connection unit 30. In another example, the plug housing 20 may include a front housing 21 and a rear housing 25. The front housing 21 includes the front portion 210 and the accommodation portion 220. The rear housing 25 is utilized for being attached to the front housing 21 so as to cover at least one side (e.g., rear side) of the terminal connection unit 30 carried by the front housing 21.

The terminal connection unit 30 has a plurality of contacts 301 and a plurality of piercing terminals 302 electrically coupled to the respective contacts 301. When the terminal connection unit 30 is carried by the plug housing 20 and the contact retainer 10 is attached to the front portion 210, the contacts 301 are disposed on the front portion 210 for electrical coupling to the network jack and the piercing terminals 302 are disposed upward on the accommodation portion 220. For example, the contacts 301 may be plug contacts or blade contacts and are exposed through the respective contact slots 101 of the contact retainer 10 when the terminal connection unit 30 is carried by the plug housing 20 so that the contacts 301 is capable of making electrical connection to corresponding contacts of the network plug. In other examples, the contacts 301 may be electrical contacts or pads; the contact retainer 10 may include, or is provided with, plug contacts or blade contacts exposed through the respective contact slots 101; and the contacts 301 may be connected to the plug contacts or blade contacts when the terminal connection unit 30 is carried by the plug housing 20.

Figure 2:
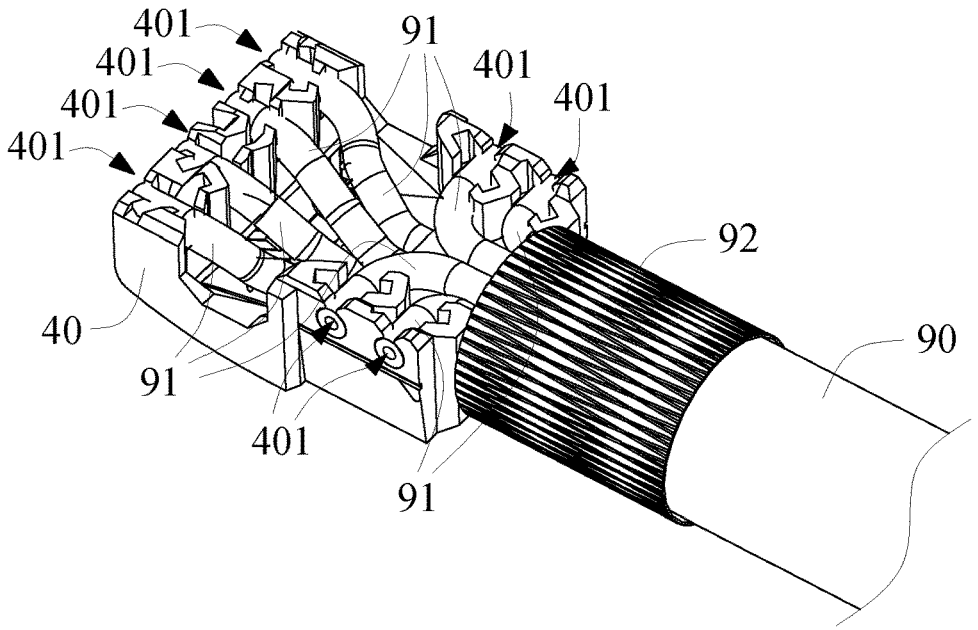
FIG. 2 is a schematic view illustrating a wire organizer of FIG. 1 with a cable attached thereto according to an embodiment.
Figure 3:
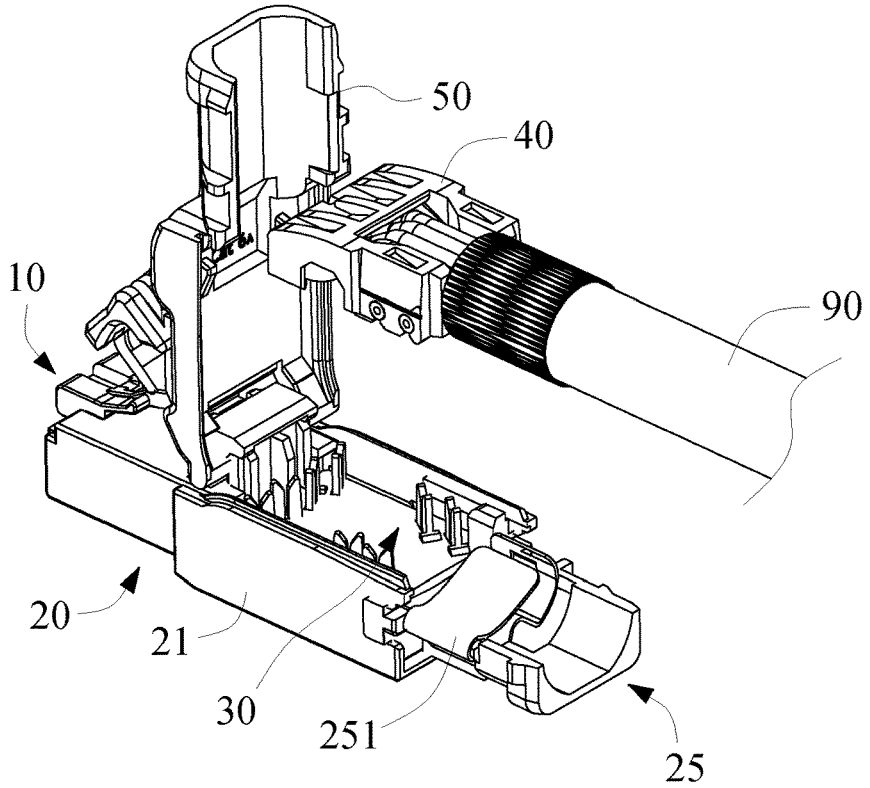
FIG. 3 is a schematic view illustrating that the terminal connection unit carried by the plug housing of the field termination plug of FIG. 1 is used for termination of the cable attached to the wire organizer of FIG. 2 according to an embodiment of the disclosure.
Figure 4:
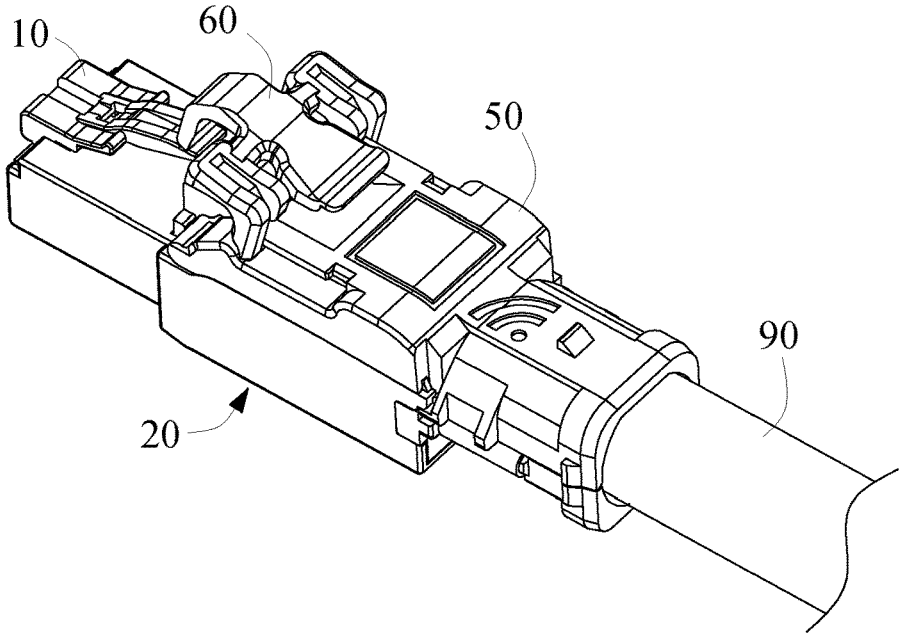
FIG. 4 is a schematic view illustrating the field termination plug of FIG. 1 with a cable terminated thereto, with a detachable latch engaging with the cover, according to an embodiment of the disclosure.

The cover 50 is pivotally connectable to the plug housing 20. As illustrated in FIGS. 1, 2 and 3, when the cover 50 is pivoted to an open position, the piercing terminals 302 of the terminal connection unit 30 carried by the plug housing 20 are exposed in the second opening 221 in order for a wire organizer 40 for attachment of the wires 91 to be removably disposed on the piercing terminals 302, wherein the cover 50 in the open position is not in contact with the wire organizer 40. As illustrated in FIGS. 3 and 4, when the cover 50 is pivoted from the open position to a closed position, the cover 50 inwardly presses the wire organizer 40 such that the wires 91 attached to the wire organizer 40 are terminated to the respective piercing terminals 302. In the closed position of the cover 50 as shown in FIG. 4, the wire organizer 40 is covered and cannot be seen.

As illustrated in FIG. 4, a detachable latch 60 may be optionally provided and installed onto the field termination plug 1. Embodiments of the detachable latch 60 will be provided later.

Referring again to FIGS. 2 and 3, it is demonstrated how the cable 90, such as a shielded one, is to be terminated with the field termination plug 1 of FIG. 1. For cable termination, the cable jacket of an end of the cable 90 is first stripped and the shield portion 92 of the cable 90, such as the screened braid and/or foil, is pulled back along the cable jacket. As illustrated in FIG. 2, the wires 91 of the cable 90 are seated into a plurality of wire-receiving slots 401 of the wire organizer 40 according to a designated wiring scheme. The wire-loaded wire organizer 40 can be loosely disposed on the terminal connection unit 30 carried by the plug housing 20, as shown in FIG. 3. When the cover 50 is pivoted from the open position, as in FIG. 3, to the closed position, as in FIG. 4, the wire organizer 40 is pressed and moved towards the piercing terminals 302 along a path and the wires 91 attached to the wire organizer 40 are finally terminated to the respective piercing terminals 302.

Figure 5:
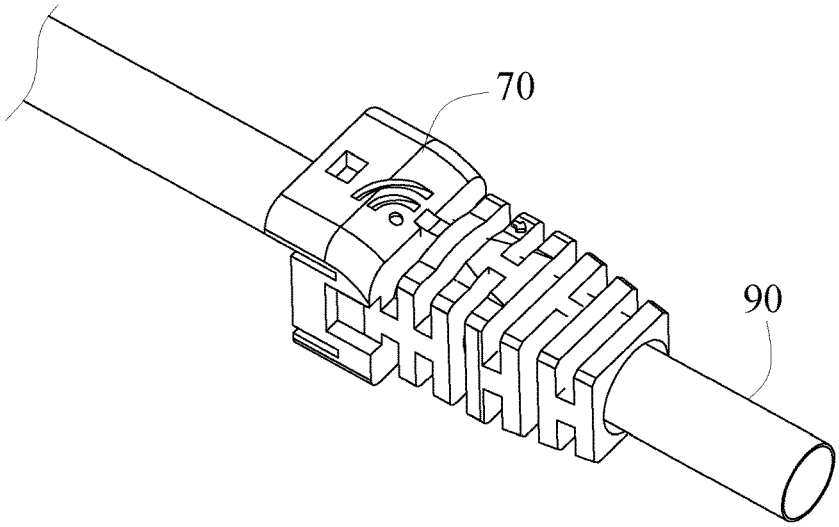
FIG. 5 is a schematic view illustrating a strain relief device according to an embodiment of the disclosure.
Figure 6:
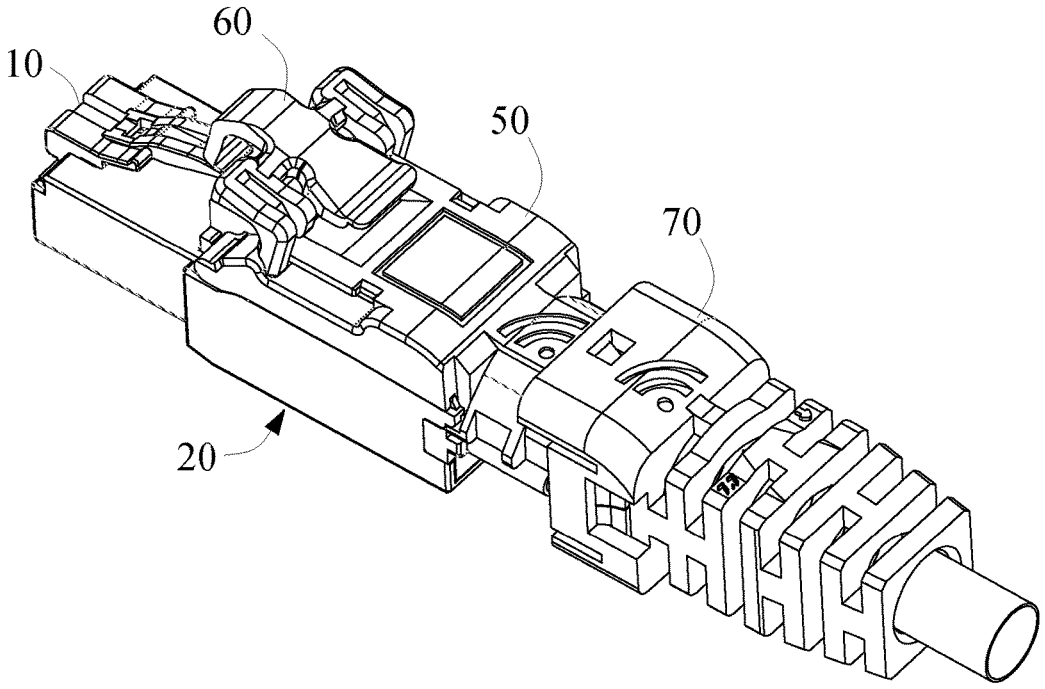
FIG. 6 is a schematic view illustrating the strain relief device of FIG. 5 secured to the field termination plug of FIG. 1 according to an embodiment of the disclosure.

For cable shield grounding, the shield portion 92 of the cable 90 can be electrically connected to a conductive part of the field termination plug 1, such as the plug housing 20 or cover 50, which may be electrically coupled to the ground, wherein at least one of the cover 50, front housing 21, and rear housing 25, in part or whole, may be conductive. A strain relief device 70, as shown in FIG. 6, may be optionally employed to secure the plug housing 20 and the cover 50 to facilitate a tight connection between the shield portion 92 of the cable 90 and the cover 50 and the rear housing 25, wherein the cable 90 is required to pass through the strain relief device 70, as shown in FIG. 5, before the cable 90 is attached to the wire organizer 40, as shown in FIG. 2. In some examples, a fastener (not shown), such as a cable tie or so on, may be used to fasten the plug housing 20 and the cover 50 to facilitate such a tight connection also. In another example, a grounding bracket 251, which is conductive, may be disposed between the shield portion 92 of the cable 90 and the plug housing 20 (such as the rear housing 25) to facilitate the cable shield grounding. The implementation of the disclosure is not limited to the above examples. Embodiments of the strain relief device 70 will be provided later.

Hence, the field termination plug 1 according to FIG. 1 is capable of being utilized readily for terminating to a cable, when needed, in the field. In some embodiments, a field termination plug according to FIG. 1 may be provided or sold without a wire organizer, and a technical person utilizes such configuration of the field termination plug and regards a wire organizer and a cable to be attached to the wire organizer as workpieces which may be provided or sold separately. In other embodiments, a field termination plug according to FIG. 1 may be provided or sold with a wire organizer which is capable of being attached to a cable for termination, and a technical person utilizes such configuration of the field termination plug and regards the wire organizer included in the field termination plug and regards a cable to be attached to the wire organizer as a workpiece which may be provided or sold separately. The implementation of the disclosure is not limited to the above embodiments.

Figure 7:
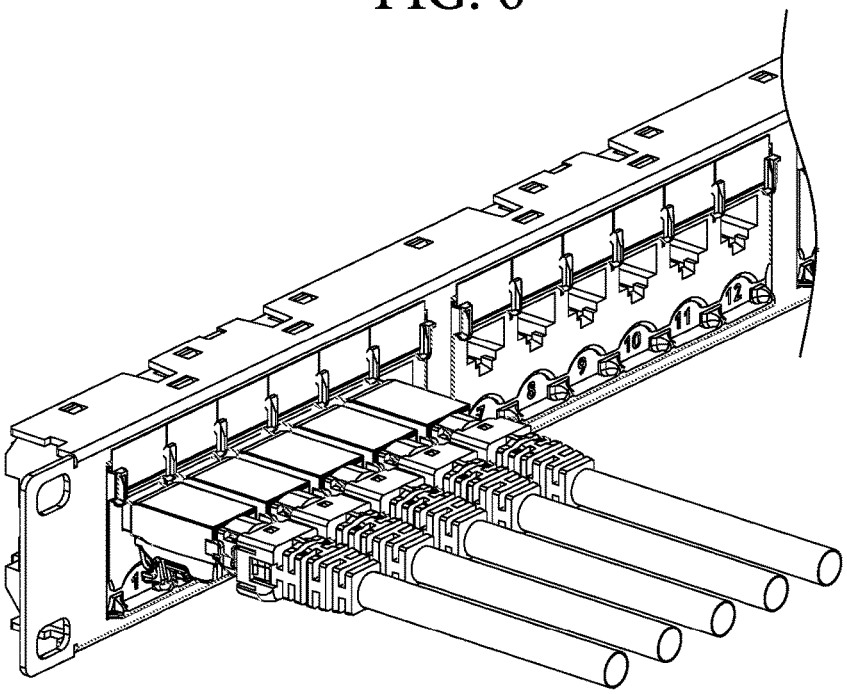
FIG. 7 is a schematic view illustrating a network device having rows of network jacks for connection to a field termination plug.

In some embodiments as will be depicted in the following, a field termination plug according to FIG. 1 is configured to have the piercing terminals disposed in simplified arrangements to facilitate cable termination for cables of different wire diameters. As illustrated in FIG. 7, the jacks of a network device are aligned one by one horizontally in groups, and any two adjacent jacks in each group is spaced apart for a specified horizontal distance, for example, 14.3 mm, between the centers thereof. Hence, there is a dimensional limitation on a field termination plug in practice. In addition, as higher speed data transmission technology becomes available and adopted, especially in data centers or server room environment, cables with greater wire diameters, are often required for signal transmission in higher speed and better performance.

Figure 8:
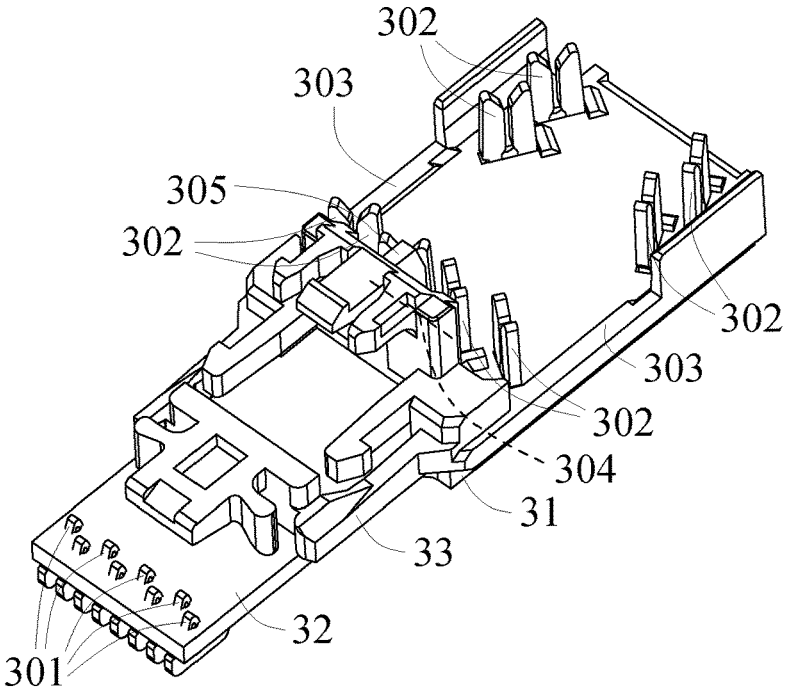
FIG. 8 is a schematic view illustrating a terminal connection unit according to an embodiment of the disclosure.

Referring to FIG. 8, a terminal connection unit 30 is configured to have the piercing terminals disposed in simplified arrangements to facilitate cable termination for cables of different wire diameters according to an embodiment of the disclosure. As shown in FIG. 8, the terminal connection unit 30 includes two opposite lateral sides 303 and an inner side 304 perpendicular to the two lateral sides 303. In addition, the piercing terminals 302 may be divided into different groups disposed adjacent to the lateral sides 303 and the inner side 304 respectively. In one embodiment, the piercing terminals 302 include a first group of piercing terminals (or referred to as group A), a second group of piercing terminals (or referred to as group B), and a third group of piercing terminals (or referred to as group C). The group A is disposed adjacent to the inner side 304, the group B is disposed adjacent to one of the lateral sides 303, and the group C is disposed adjacent to another one of the lateral sides 303.

Figure 9:
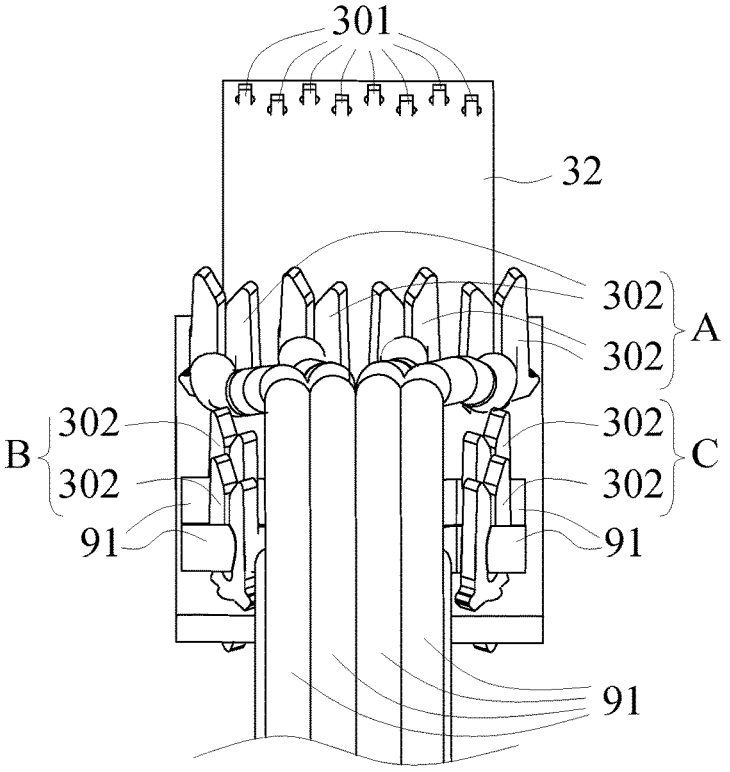
FIG. 9 is a schematic view illustrating the circuit board of FIG. 8 with a cable terminated thereto according to an embodiment of the disclosure.

Referring to FIG. 9, a circuit board 32 included in the terminal connection unit 30 of FIG. 8 is illustrated with a cable terminated thereto according to an embodiment of the disclosure. As shown in FIG. 9, the group A has four of the piercing terminals 302 for terminating four of the wires, the group B has two of the piercing terminals 302 for terminating another two of the wires, and the group C has two of the piercing terminals 302 for terminating yet another two of the wires.

Figure 10:
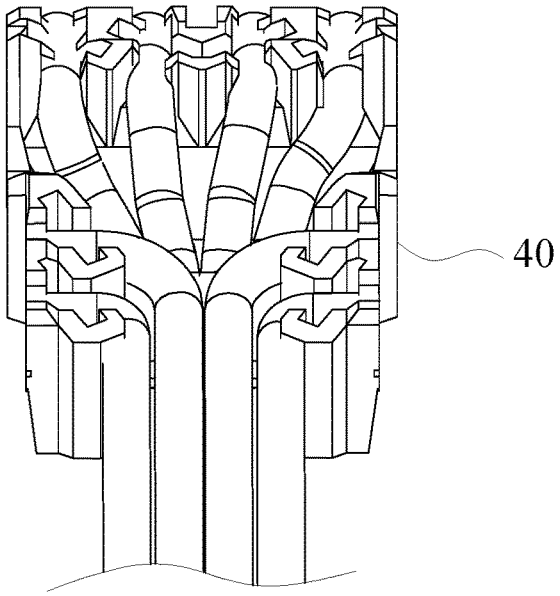
FIG. 10 is a schematic view illustrating a wire organizer with a cable attached thereto according to an embodiment of the disclosure.

Referring to FIG. 10, a wire organizer 40 is illustrated with a cable attached thereto according to an embodiment of the disclosure. In FIG. 10, the wires of the cable, as illustrated in FIG. 9, may be seated into the wire-receiving slots 401 of the wire organizer 40 which is capable of being mated with the piercing terminals 302, as illustrated in FIG. 8.

Figure 11:
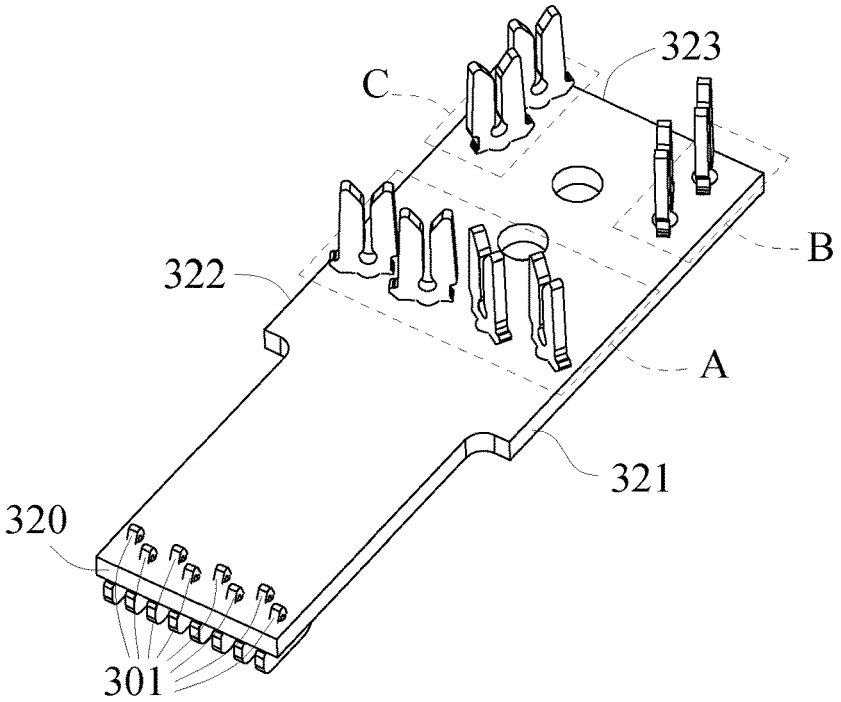
FIG. 11 is a perspective view illustrating a circuit board of the terminal connection unit of FIG. 9 according to an embodiment of the disclosure.

Referring to FIGS. 11 and 12, the circuit board 32 of FIG. 9 is illustrated according to an embodiment of the disclosure. As shown in FIGS. 11 and 12, the circuit board 32 has a front edge 320, lateral edges 321, 322, and a rear edge 323. The contacts 301 may be mounted adjacent to the front edge 320 and the piercing terminals 302 may be mounted adjacent to the lateral edges 321, 322 and the middle of the circuit board 32, respectively. While the contacts 301 may extend vertically on one surface of the circuit board 32, the piercing terminals 302 may extend vertically on the opposite surface of the circuit board 32. FIG. 12A illustrates the circuit board 32 in a top view. As shown in FIG. 12A, the piercing terminals of the group A are arranged symmetrically with respect to a longitudinal axis Y of the circuit board 32, and the groups B and C are also symmetrically arranged with respect to the longitudinal axis Y. Each piercing terminal transversely makes a respective angle with the longitudinal axis Y (or vertical axis) or a transversal axis X (or horizontal axis) of the circuit board 32. For the group A shown in FIG. 12A, two piercing terminals on the right side each make an angle of al with the transversal axis X (or the lateral edge 322) and another two piercing terminals on the left side each make an angle of $\alpha 2$ with the transversal axis −X. The two piercing terminals of the group B each make an angle of $\beta 1$ with the longitudinal axis Y (or the lateral edge 321) and the two piercing terminals of the group C each make an angle of $\beta 2$ with the longitudinal axis Y (or the lateral edge 322). In some embodiments, $\alpha 1$, $\alpha 2$, $\beta 1$ and $\beta 2$ are all equal, as illustrated in FIG. 12A. In some embodiments, $\alpha 2$ is equal to $\alpha 1$ and $\beta 2$ is equal to $\beta 1$, wherein $\alpha 1$ is not equal to $\beta 1$. Further, each of the angles $\alpha 1$, $\alpha 2$, $\beta 1$ and $\beta 2$ may be set arbitrarily wherever appropriate, such as 25°, 30°, 35°, 40°, 45°, 50°, 60° and so on. The implementation of the disclosure is not limited to the above examples.

Figure 12A:
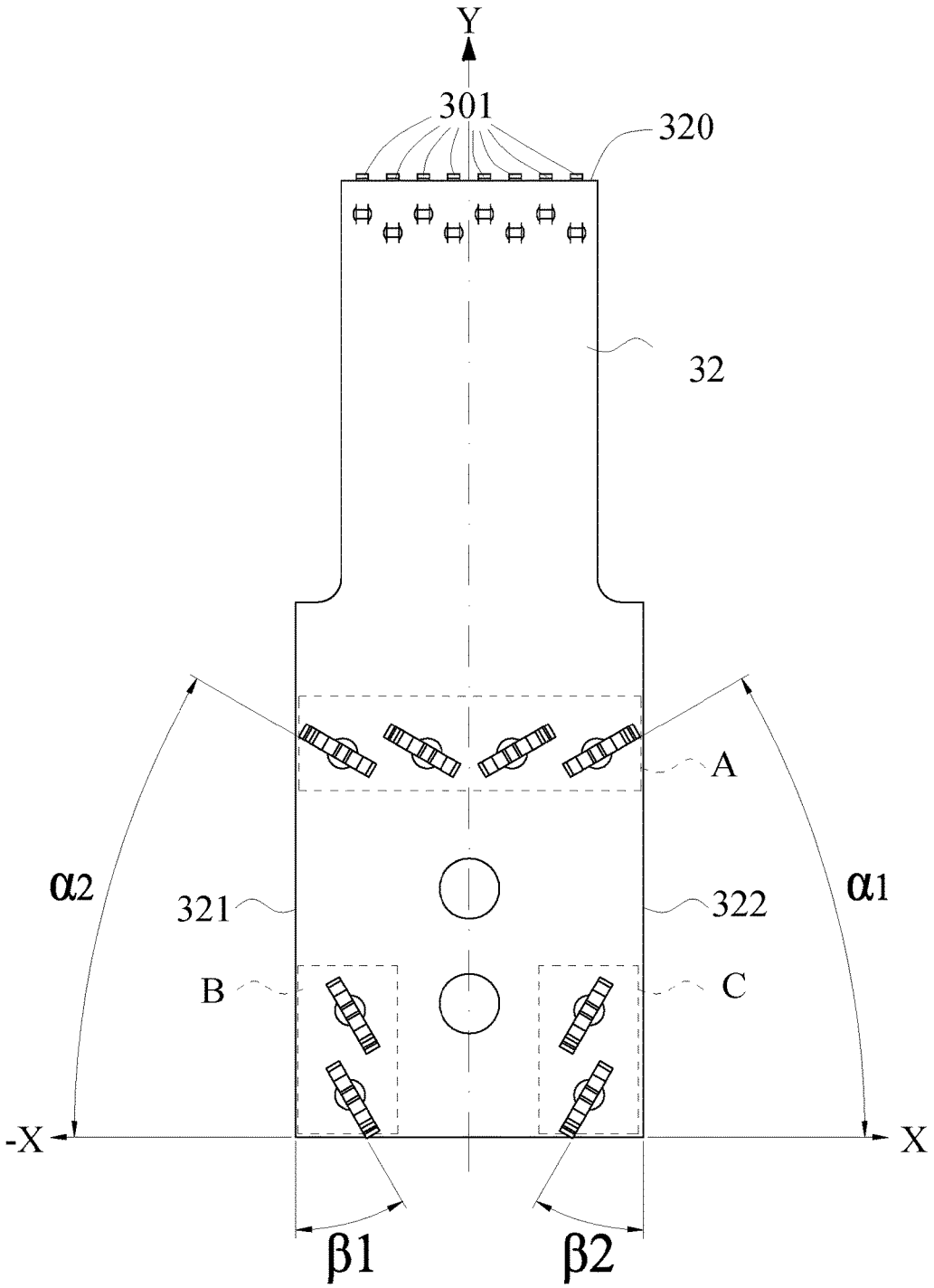
FIG. 12A is a top view illustrating the circuit board of FIG. 11 according to an embodiment of the disclosure.
Figure 12B:
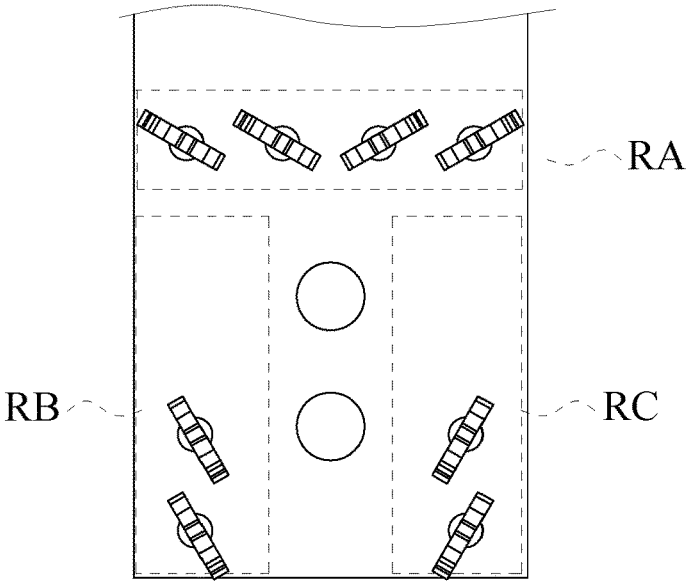
FIG. 12B is a top view illustrating regions arranged on the circuit board for piercing terminals according to an embodiment of the disclosure.
Figure 12C:
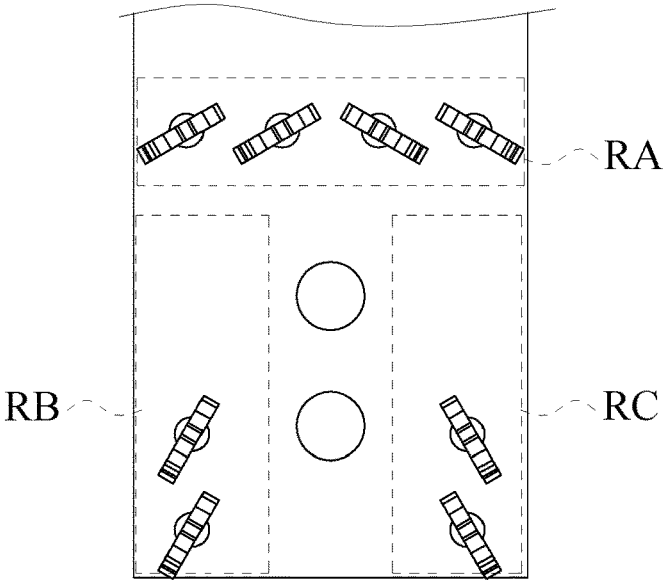
FIG. 12C is a top view illustrating the piercing terminals arranged on the circuit board according to an embodiment of the disclosure.
Figure 12D:
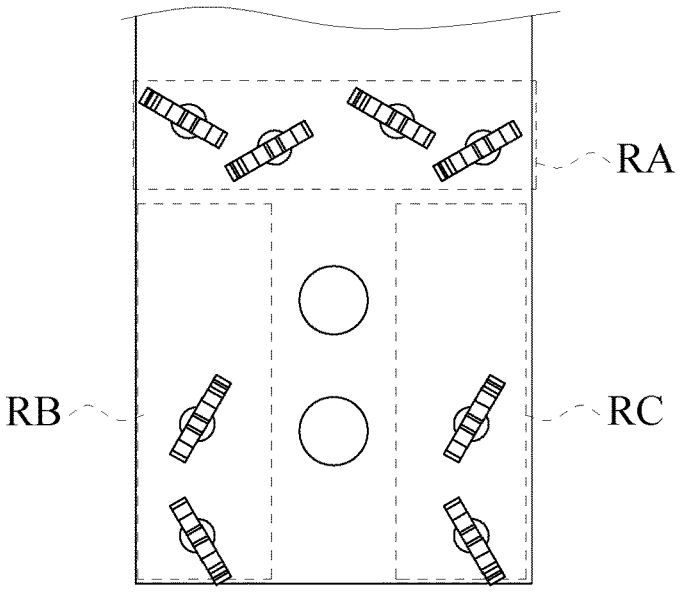
FIG. 12D is a top view illustrating the piercing terminals arranged on the circuit board according to an embodiment of the disclosure.
Figure 12E:
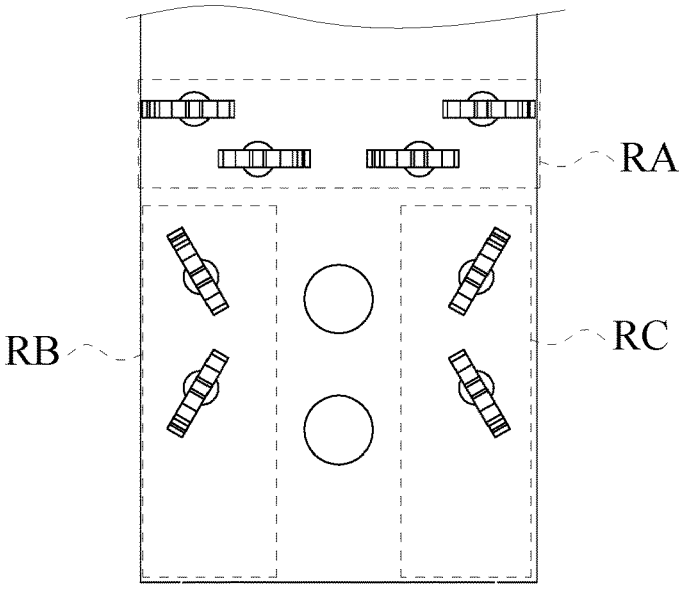
FIG. 12E is a top view illustrating the piercing terminals arranged on the circuit board according to an embodiment of the disclosure.

In some embodiments, the piercing terminals may be disposed on the circuit board 32 in arrangements other than that shown in FIG. 12A. FIGS. 12B-12E illustrate arrangements of piercing terminals on the circuit board according to some embodiments in top views. As shown in FIG. 12B, a portion of the circuit board 32 where the piercing terminals may be disposed is divided into three regions, namely, RA, RB, RC. Region RA is elongated parallel to the transversal axis X. Regions RB and RC are elongated parallel to the longitudinal axis Y, along the lateral edges 321 and 322 respectively. Each piercing terminal in the regions RA, RB, RC may arbitrarily make an individual angle with the longitudinal axis Y (or vertical axis) or a transversal axis X (or horizontal axis) of the circuit board 32. For example, an arrangement of the piercing terminals as shown in FIG. 12C is a substantial inversion of that in FIG. 12A. FIGS. 12D and 12E show another two arbitrary arrangements of the piercing terminals in three groups. As illustrated above, the piercing terminals may be disposed on the portion of the circuit board 32 in an evenly distributed manner, thus making cable termination more readily and effectively.

Figure 13:
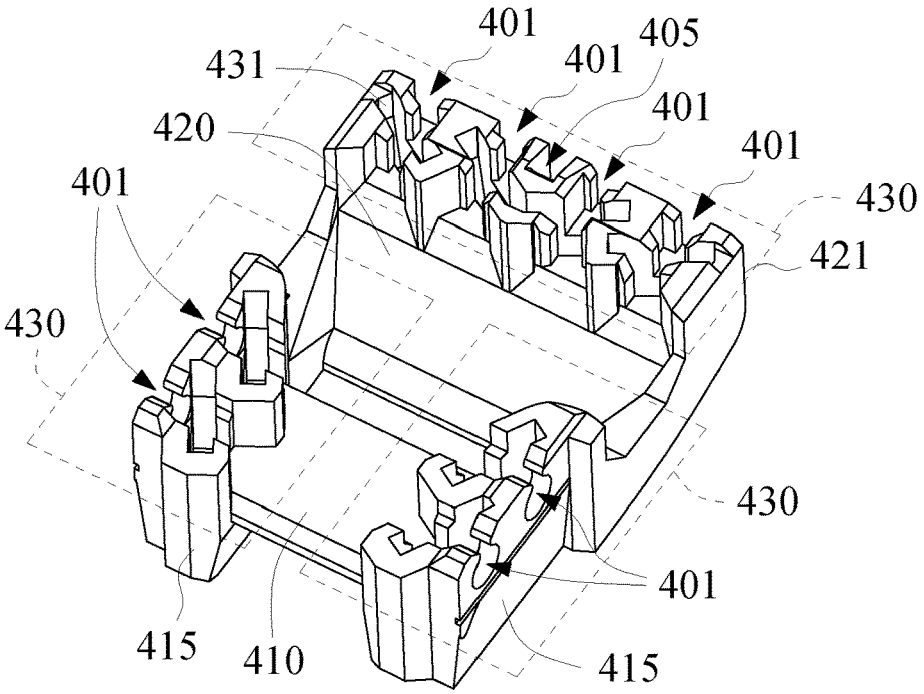
FIG. 13 is a bottom perspective view of a wire organizer for mating with the terminal connection unit of FIG. 8 according to an embodiment of the disclosure.
Figure 14:
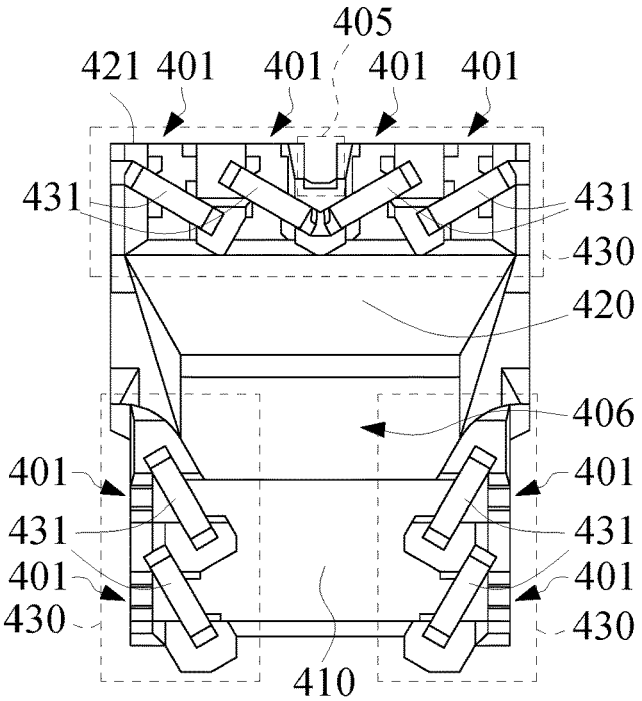
FIG. 14 is a bottom view of the wire organizer of FIG. 13 according to an embodiment of the disclosure.

In addition, a wire organizer can be realized correspondingly in order to match with the piercing terminals in one of the above arrangements. Referring to FIGS. 13 and 14, a wire organizer 40 is illustrated for mating with the terminal connection unit of FIG. 8 with the piercing terminals arranged as in FIG. 12A, according to an embodiment of the disclosure. FIG. 13 shows a bottom perspective view of the wire organizer 40. FIG. 14 is a bottom view of the wire organizer 40. As shown in FIG. 13, the wire organizer 40 includes a wire-receiving body and a plurality of wire-receiving portions 430. As shown in FIGS. 13 and 14, each of the wiring-receiving portions 430 has a corresponding one of the wire-receiving slots 401 for receiving a wire of a cable and an aperture 431 for mating the corresponding piercing terminal 302 as arranged in FIG. 12A.

As shown in FIGS. 13 and 14, the wire-receiving body includes a separation portion 410, lateral portions 415, and a cover portion 420. The lateral portions 415 are disposed on two lateral sides of the separation portion 410 and extend to two lateral sides of the cover portion 420. Some of the wire-receiving portions 430 are disposed under the lateral portions 415 on the left side and right side while some of the wire-receiving portions 430 are disposed under a front side 421 of the cover portion 420.

As shown in FIG. 14, four of the wire-receiving portions 430 under the front side 421 have four corresponding ones of the wire-receiving slots 401 for receiving four wires of a cable longitudinally. Four of the wire-receiving portions 430 under the lateral portions 415 have another four corresponding ones of the wire-receiving slots 401 for transversally receiving two wires of the cable on the left side and another two wires of the cable on the right side.

As illustrated in FIG. 14, the wire organizer 40 has an opening 406 between the separation portion 410 and the cover portion 420. Referring again to FIG. 10, four wires of the cable may be passed under the separation portion 410 and inserted into the opening 406 in order to reach the wiring-receiving portions 430 disposed under the front side 421. Another four wires of the cable may be passed over the separation portion 410 so as to reach the wiring-receiving portions 430 disposed under the lateral portions 415 on the left side and right side.

Referring back to FIG. 8, in some embodiments, the terminal connection unit 30 may further have a first guiding element 305 disposed between the contacts 301 and the first group of piercing terminals 302 adjacent to the inner side 304.

Referring to FIGS. 13 and 14, in an embodiment, a second guiding element 405 may be included on the front side 421 for engaging with the first guiding element 305 so as to define a path for facilitating cable termination. Referring again to FIGS. 3 and 4, when the cover 50 is pivoted from the open position, as in FIG. 3, to the closed position, as in FIG. 4, the wire organizer 40 is pressed and moved towards the piercing terminals 302 along the path defined by the first guiding element 305 and second guiding element 405, and the wires 91 attached to the wire organizer 40 are finally terminated to the respective piercing terminals 302.

Figure 15:
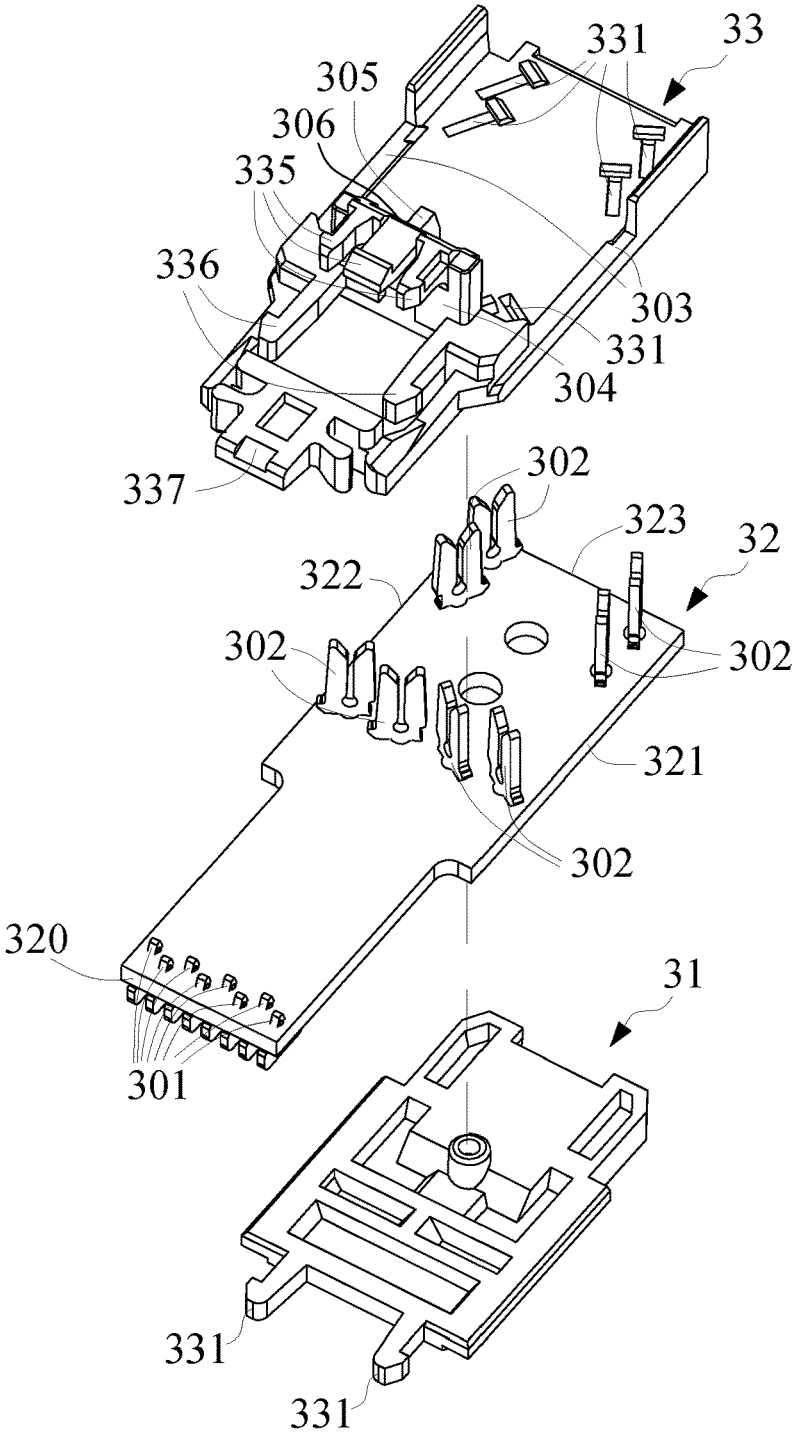
FIG. 15 is an exploded view illustrating the terminal connection unit of FIG. 8 according to an embodiment of the disclosure.

Referring to FIG. 15, the terminal connection unit 30 of FIG. 8 is illustrated in an exploded view according to an embodiment of the disclosure. As shown in FIG. 15, the terminal connection unit 30 includes an insulation base 31, the circuit board 32, and a terminal connection housing 33. The circuit board 32 is disposed between the insulation base 31 and terminal connection housing 33.

The terminal connection housing 33 covers the circuit board 32 partially and has openings 331 through which the piercing terminals 302 are exposed partially. The first guiding element 305 may be included in the terminal connection housing 33.

In an embodiment, the first guiding element 305 may have a top section 306, as shown in FIGS. 8 and 15, and the front portion 210 of the plug housing 20 may have a bearing section 215, as shown in FIG. 1. The bearing section 215 and the top section 306 form a bearing for pivotal connection between the cover 50 and the plug housing 20, when the terminal connection unit 30 is carried by the plug housing 20. For example, the cover 50, as illustrated in FIG. 1, may include a protection portion 51 and a pivot section 511 that extends from the protection portion 51 and can engage with the bearing formed by the bearing section 215 and the top section 306 so as to perform pivotal movement. In another embodiment, the front portion 210 of the plug housing 20 may have a self-contained bearing for pivotal connection between the cover 50 and the plug housing 20, without the need of the terminal connection unit. The implementation of the disclosure is not limited to the above examples.

As shown in FIG. 15, the terminal connection housing 33 may further include securing elements 335 extending from the first guiding element 305 for engaging with the bearing section 215. In some embodiments, the terminal connection housing 33 may further include securing elements 336 extending from the lateral sides 303 for engaging with interior sidewalls of the front portion 210 of the plug housing 20.

In an embodiment, the insulation base 31 may have resilient components, for example, securing arms 331, for engaging with an interior sidewall of the front housing 21 so as to secure the insulation base 31 and the terminal connection unit 30 to the front housing 21.

In some examples, male and female parts (e.g., protrusions and openings) or any mating parts may be implemented on any two of the insulation base 31, circuit board 32, and terminal connection housing 33 for engagement and securing.

Figure 16:
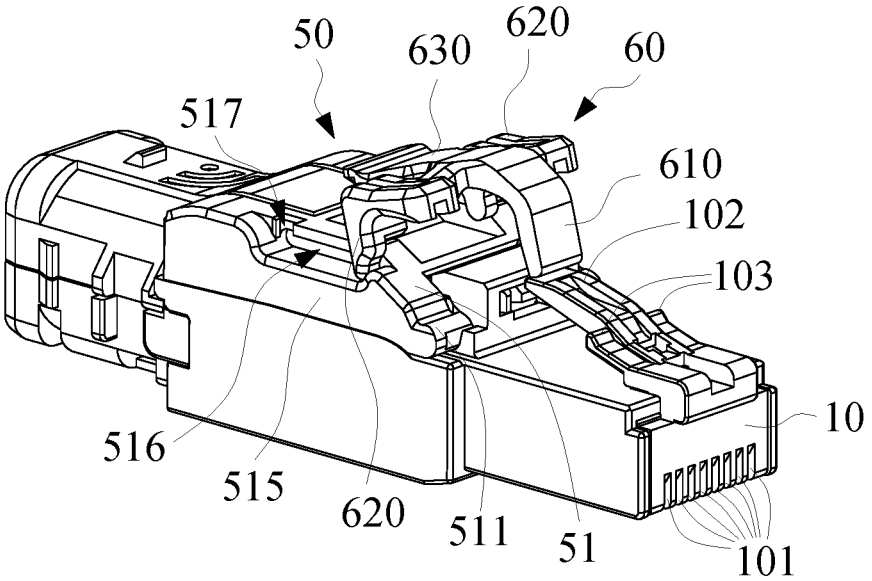
FIG. 16 is a perspective view illustrating a field termination plug with a detachable latch according to an embodiment of the disclosure.
Figure 17:
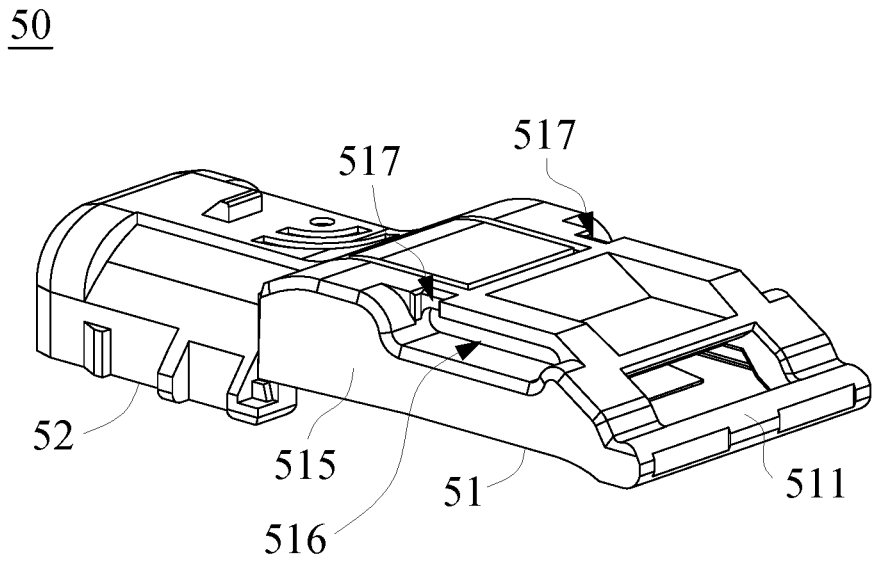
FIG. 17 is a perspective view illustrating the cover of FIG. 16 according to an embodiment of the disclosure.
Figure 18:
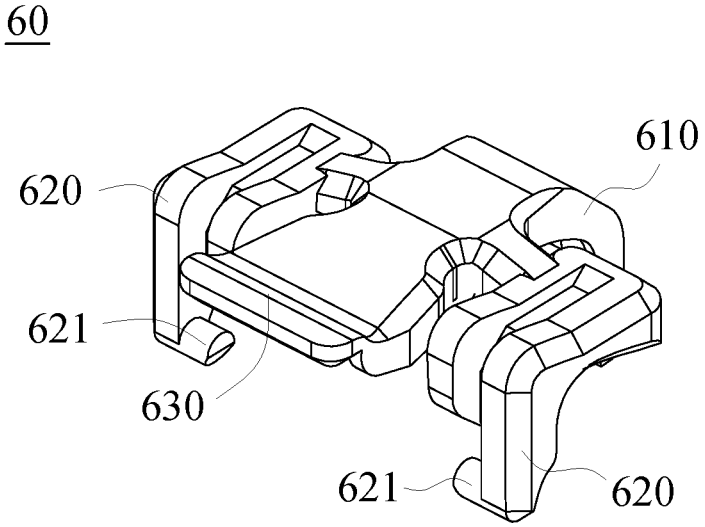
FIG. 18 is a perspective view illustrating the detachable latch of FIG. 16 according to an embodiment of the disclosure.

Referring to FIGS. 16 to 18, a field termination plug, a cover, and a detachable latch are illustrated according to embodiments of the disclosure. As shown in FIG. 16, a detachable latch 60 may be provided for movably engaging with the cover 50 of the field termination plug. Referring to FIGS. 16 and 17, in an embodiment, the cover 50 may include a protection portion 51 and a pivot section 511 extending from the protection portion 51. The pivot section 511 is used for being pivotally engaged with the plug housing 20, for example, in a bearing arrangement, such as a hinge arrangement. The protection portion 51 has lateral sides 515 and grooves 516 along the lateral sides 515. Referring to FIGS. 16, 17 and 18, the detachable latch 60 includes a front arm 610, engaging arms 620 for engaging with the grooves 516 and a rear member 630 extending from the front arm 610 and the engaging arms 620. The engaging arms 620 each may have a protrusion 621 extending transversally inward for engaging with the respective groove 516 in order to facilitate translation movement of the detachable latch 60 along the grooves 516. As shown in FIG. 18, the front arm 610 of the detachable latch 60 is capable of being in contact with the plug lever 102 of the contact retainer 10 when the detachable latch 60 is moved forwardly to one end of the grooves 516.

Figure 19:
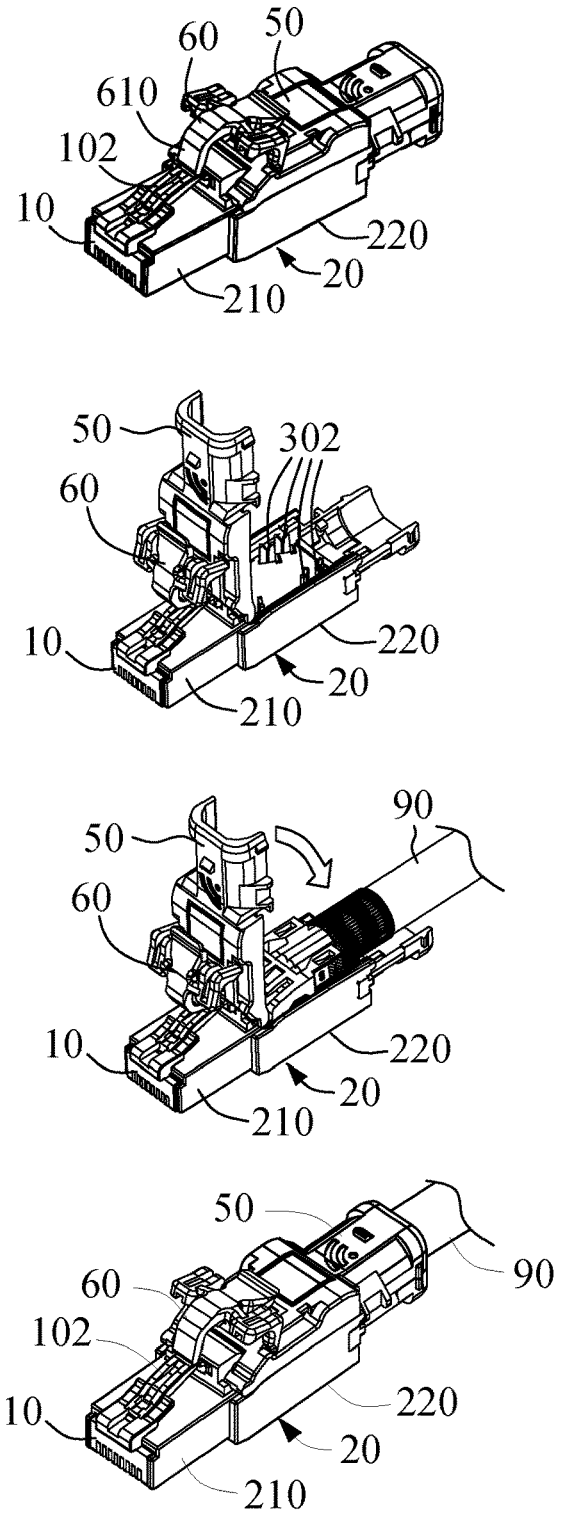
FIG. 19 is a schematic view illustrating the movement of the detachable latch of the field termination plug with its cover pivoted from the closed position to the open position to the closed position according to an embodiment of the disclosure.

Referring to FIG. 19, the movement of the detachable latch 60 of the field termination plug with its cover 50 pivoted from the closed position to the open position to the closed position is illustrated in sequential views of the field termination plug according to an embodiment of the disclosure. As shown in FIG. 19, the detachable latch 60 is utilized for detachably engaging with the grooves 516 and for moving along a traveling path defined by the grooves 516 when the cover 50 is pivoted from the closed position to the open position. As illustrated in the second view from the top of FIG. 19, the cover 50 is stopped by way of the engagement of the detachable latch 60 and plug lever 102 and is obtusely angled with respect to the accommodation portion 220 of the plug housing 20 when the cover 50 is pivoted to the open position. In this way, a technician can easily dispose the wire organizer 40 with the cable 90 attached thereto on the terminal connection unit 30 with the piercing terminals 302 exposed on the accommodation portion 220, without the need of stopping the cover 50 by hand. After that, the technician can pivot the cover 50 from the open position to the closed position, as illustrated in the third and fourth views of FIG. 19, so that the cover 50 inwardly presses the wire organizer 40 and thus make the wires 91 attached to the wire organizer 40 being terminated to the respective piercing terminals 302. Hence, the installation of the field termination plug becomes more readily and efficiently.

Figure 20:
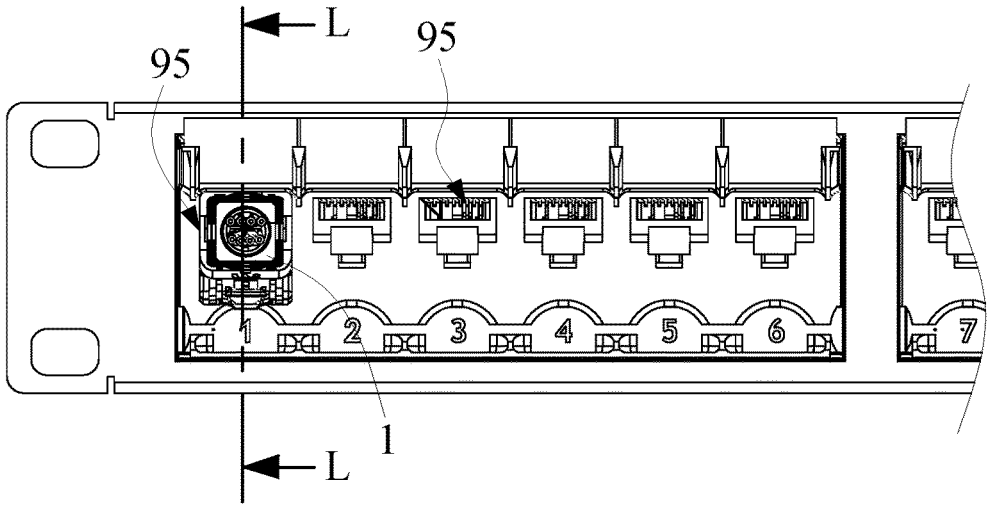
FIG. 20 is a front view illustrating the field termination plug of FIG. 16 is inserted into a patch panel according to an embodiment of the disclosure.
Figure 21:
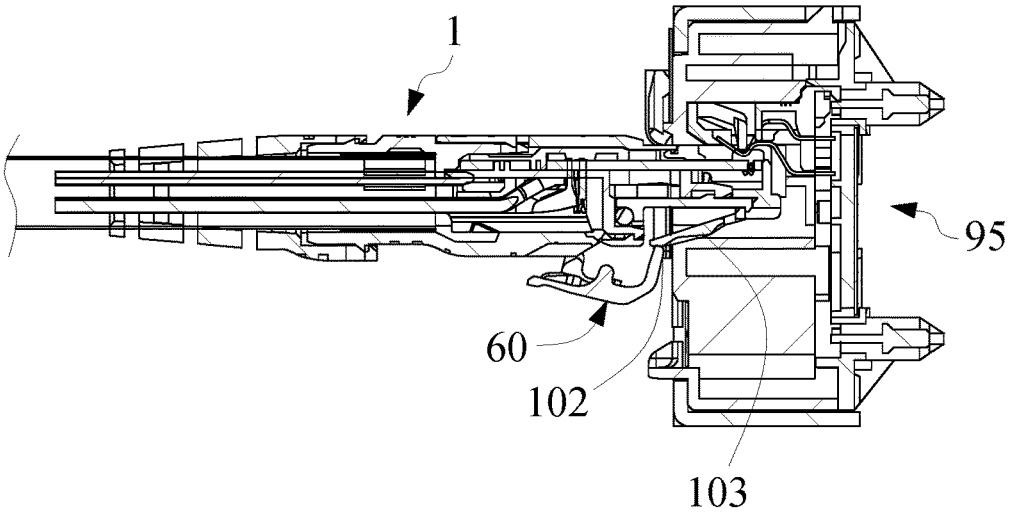
FIG. 21 is a cross-sectional view taken along line L-L in FIG. 20.
Figure 22:
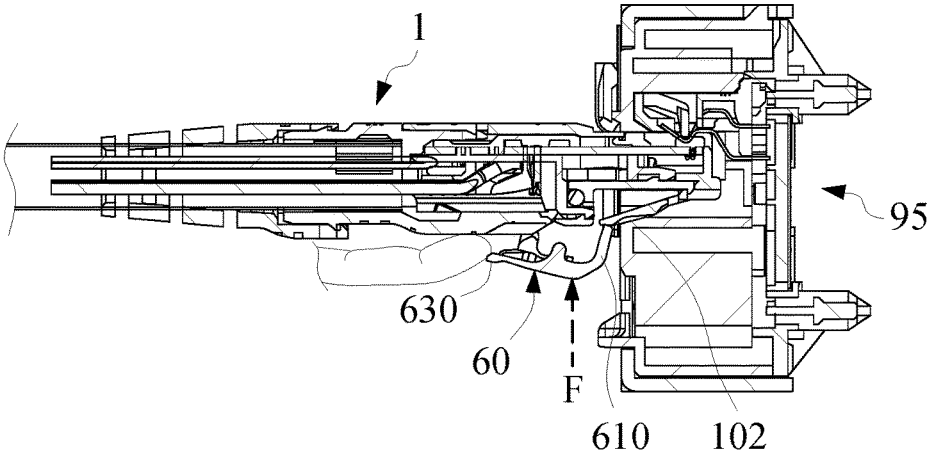
FIG. 22 illustrates engagement between the detachable latch and plug lever when a force is applied to the detachable latch.
Figure 23:
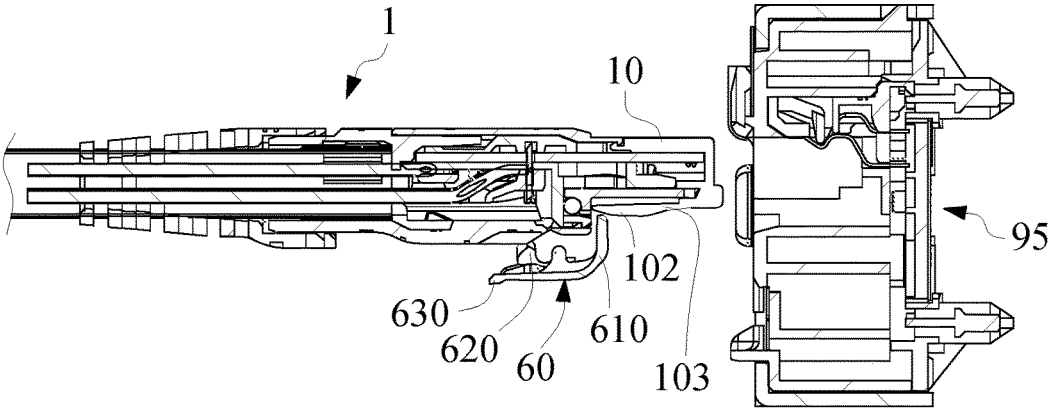
FIG. 23 illustrates removal of the field termination plug.

The detachable latch 60 may further provide various functionalities. In an embodiment as illustrated in FIGS. 20 to 23, the detachable latch 60 may facilitate the release of the field termination plug when inserted into a network jack. FIG. 20 shows the field termination plug 1 of FIG. 16 being inserted into a network jack 95 of a patch panel. FIG. 21 illustrates a cross-sectional view taken along line L-L in FIG. 20. Stops 103, as illustrated in FIG. 16, extending at the base of the plug lever 102 of the contact retainer 10 operate in conjunction with stops (not shown) of the network jack 95 to prevent the field termination plug 1 from being removed from the network jack 95 once the field termination plug 1 has been fully inserted into the network jack 95, as illustrated in FIG. 21. By applying a forwardly-directed force to the detachable latch 60, e.g., at the rear edge of the rear member 630, or an upwardly-directed force to the detachable latch 60, e.g., at any position between the front arm 610 and engaging arms 620, an upwardly-directed force will be applied to the plug lever 102 of the contact retainer 10 by way of the engagement between the detachable latch 60 and plug lever 102. As illustrated in FIGS. 22 and 23, the front arm 610 is used for depressing the plug lever 102 when the front arm 610 is pivoted toward the plug lever 102 with respect to the engaging arms 620, while the cover 50 is in the closed position and the detachable latch 60 is positioned at a first end of the traveling path, so as to permit release of the field termination plug 1 from the network jack 95. In this way, the stops 103 of the contact retainer 10 will disengage with the stops of the network jack 95 when an upwardly-directed force is applied to the plug lever 102, as illustrated in FIG. 22, and thus the field termination plug 1, as pulled backwardly, can be removed from the network jack 95, as illustrated in FIG. 23. Hence, a technician may remove the field termination plug 1 by inserting this finger below and in contact with the rear edge of the rear member 630 so as to lever down the plug lever 102, thus simplifying the way of removal of the field termination plug 1.

Figure 24:
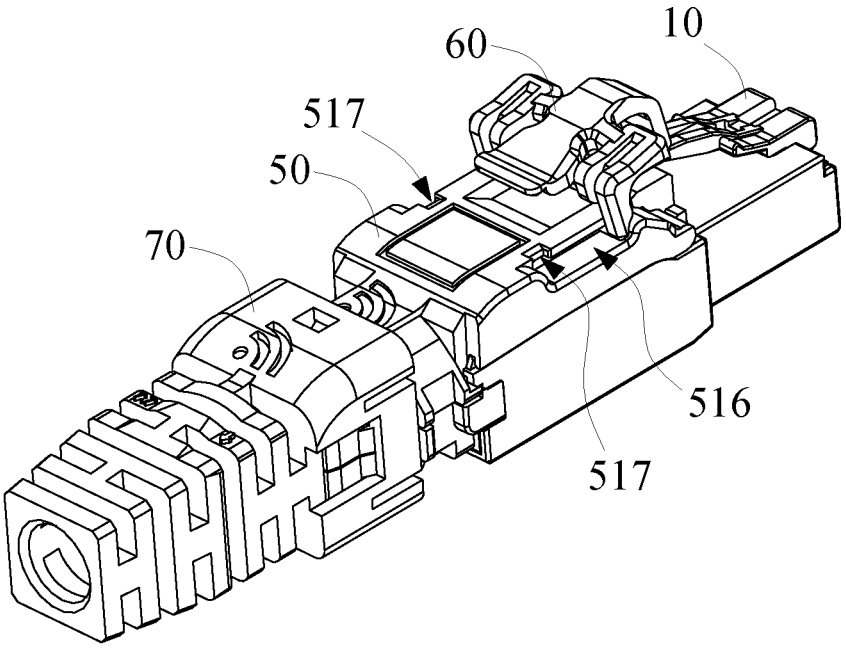
FIG. 24 is a top perspective view illustrating the detachable latch in a first end of the traveling path.
Figure 25:
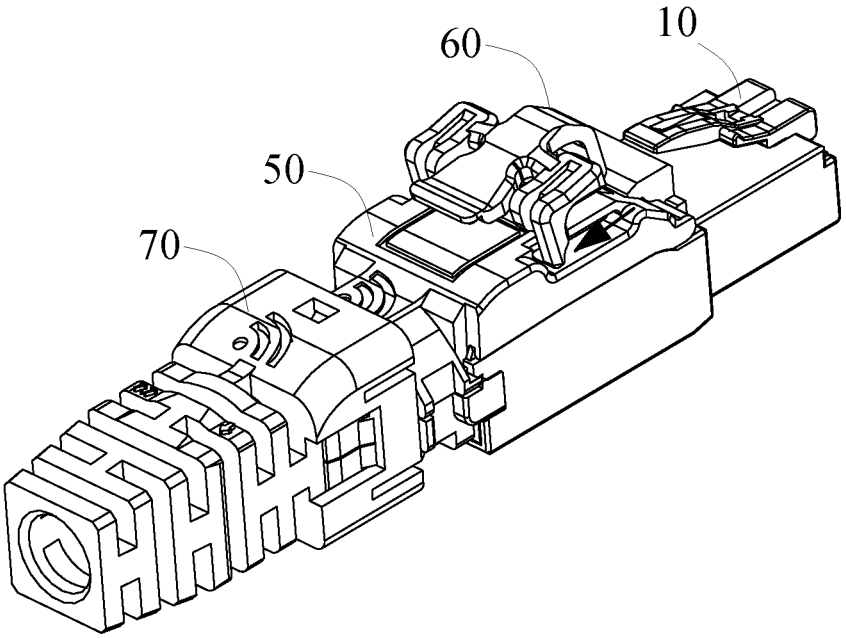
FIG. 25 is a top perspective view illustrating the detachable latch in a second end of the traveling path.
Figure 26:
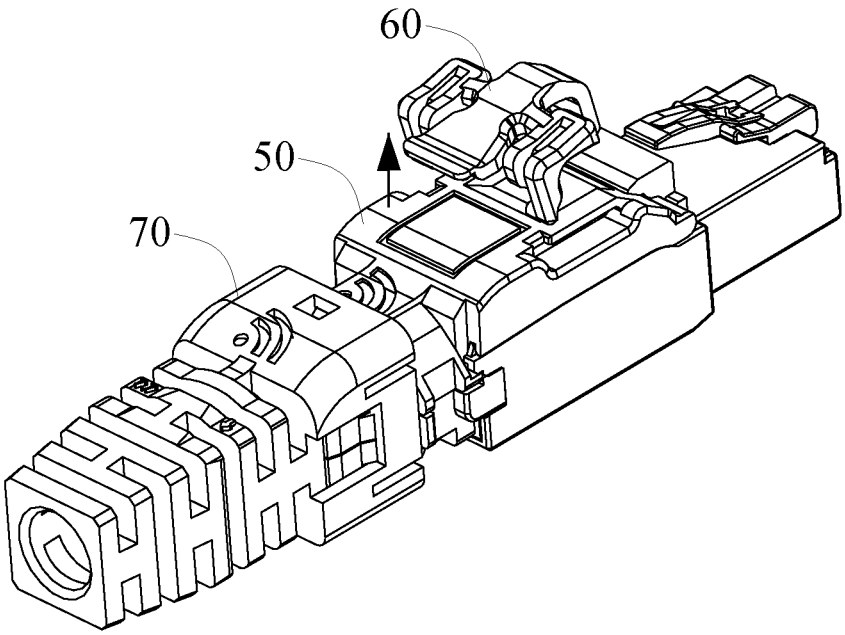
FIG. 26 is a schematic view illustrating the detachable latch being detached from the cover.
Figure 27:
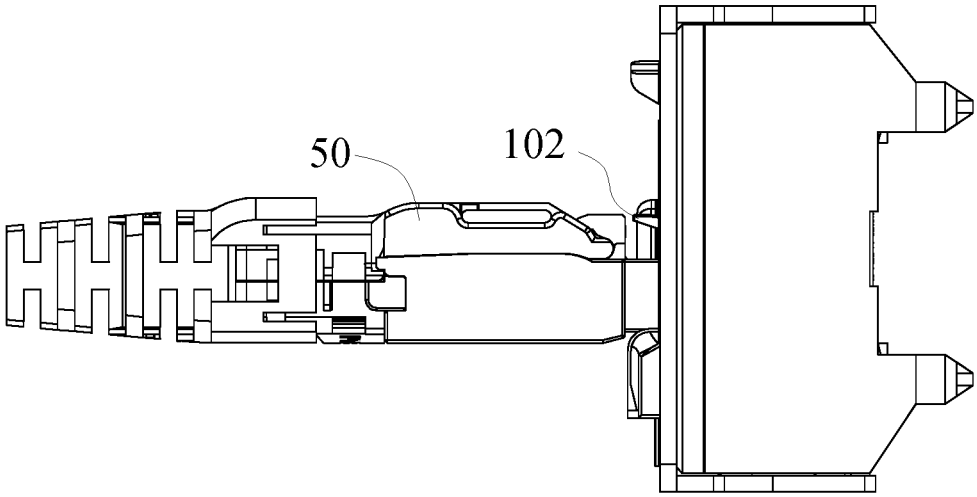
FIG. 27 is a schematic view illustrating the field termination plug being inserted into the network jack without the detachable latch.

In an embodiment, the detachable latch 60 is capable of being detached from the cover 50 when the detachable latch 60 is positioned at a second end of the traveling path so as to prevent depression of the plug lever as the field termination plug being connected to the network jack, as illustrated in FIGS. 24 to 27. A technician may first backwardly move the detachable latch 60 in a first end of the traveling path defined by the grooves 516, as illustrated in FIG. 24, to a second end of the traveling path, as illustrated in FIG. 25, where indentations 517 at edges for the grooves 516 are defined in the cover 50 so that the technician may upwardly pull the detachable latch 60 to detach the detachable latch 60 from the cover 50, as illustrated in FIG. 26. In some examples, the indentations 517 may be beveled, chamfered, or filleted so as to facilitate the detachment of the detachable latch 60. FIG. 27 illustrates the field termination plug being inserted into the network jack without the detachable latch 60. After the detachment of the detachable latch 60, it will be difficult to remove the field termination plug from the network jack 95 because there is too little space (e.g., about 2 mm) for one to depress the plug lever 102 for release the field termination plug from the network jack 95. In this way, the detachment of the detachable latch 60 results in security functionality for preventing an unauthorized person from intentionally or unintentionally removing the field termination plug from the network jack 95. In order to release of the field termination plug, the technician may install the detachable latch 60 into the cover 50 of the field termination plug of FIG. 27 and follow the way as shown in FIGS. 21 to 23 to remove the field termination plug. Hence, Ethernet security, also known as RJ-45 Port Lock, can be achieved by way of the detachable latch 60 and cover 50.

Figure 28:
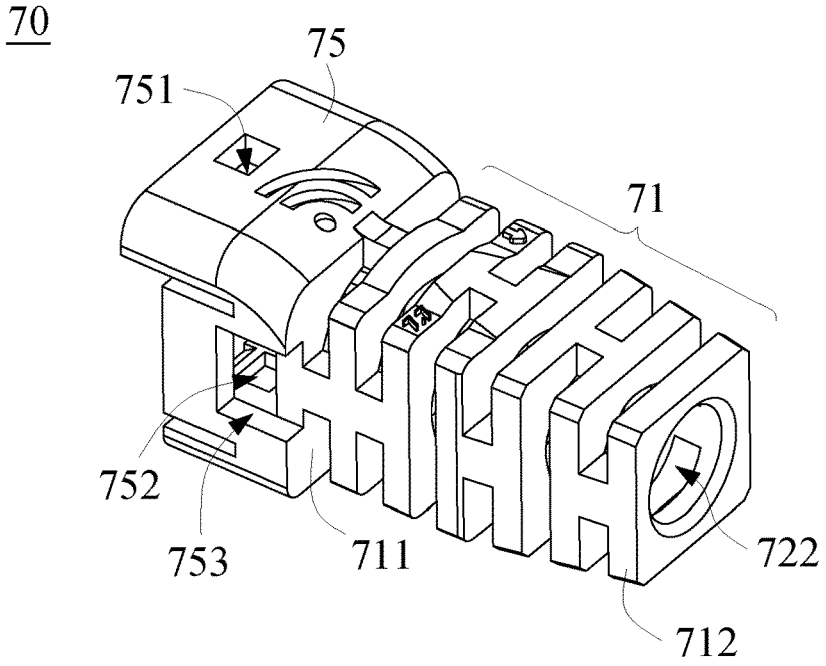
FIG. 28 is a top perspective view illustrating a strain relief device according to an embodiment of the disclosure.
Figure 29:
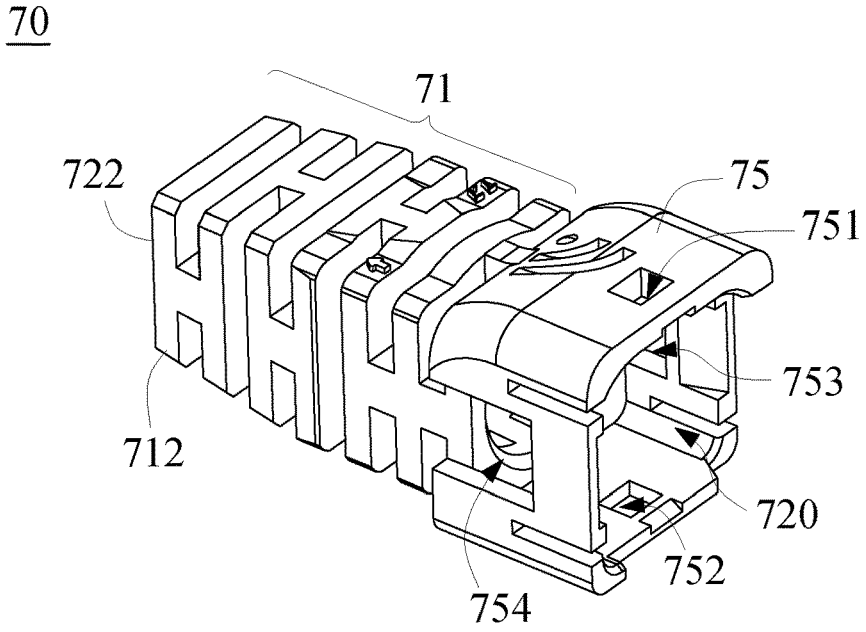
FIG. 29 is a rear top perspective view illustrating the strain relief device of FIG. 28.
Figure 30:
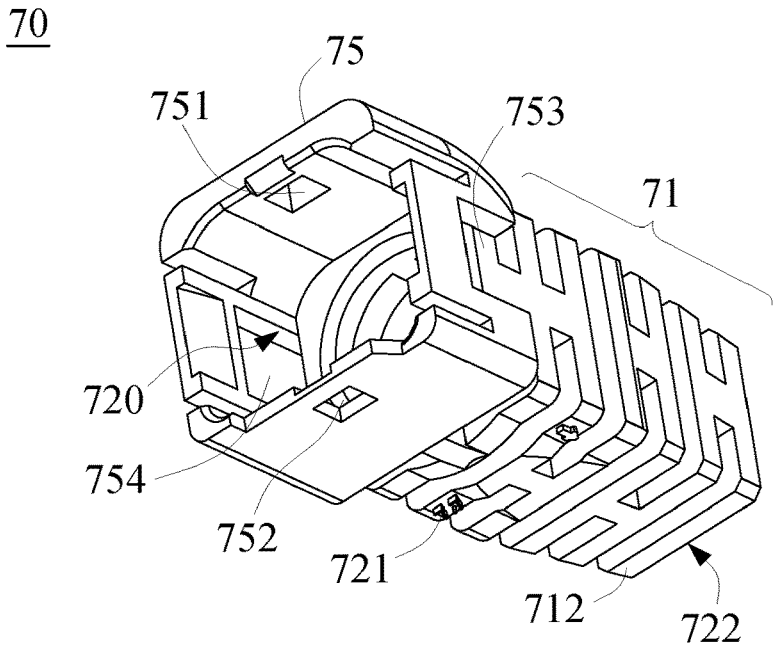
FIG. 30 is a rear bottom perspective view illustrating the strain relief device of FIG. 28.
Figure 31:
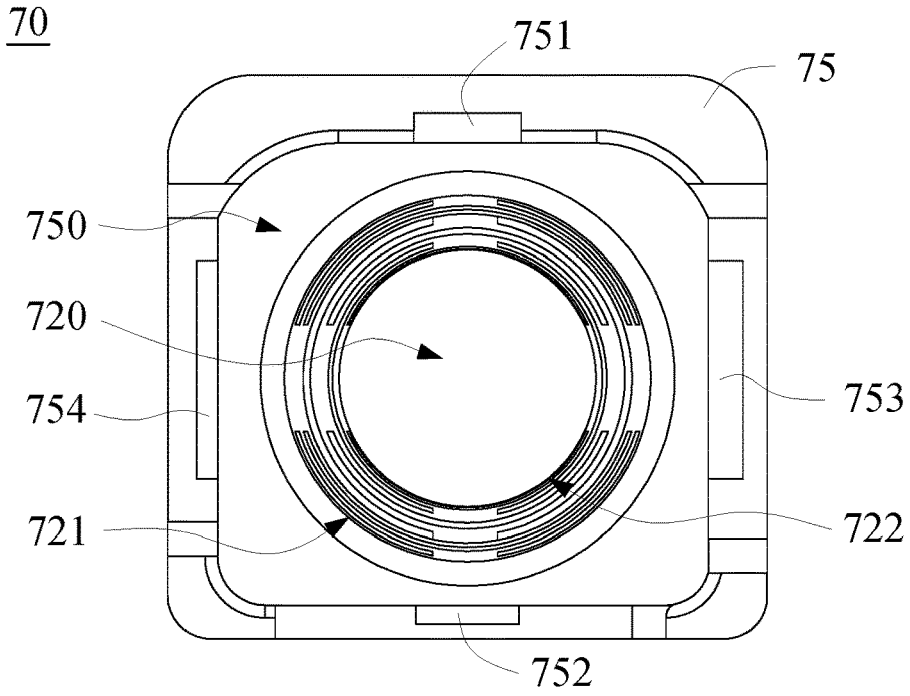
FIG. 31 is a rear view illustrating the strain relief device of FIG. 28.

According to further embodiments, a strain relief device 70 is provided for a communication plug, such as the above field termination plug, as shown in FIGS. 5, 6, and 24, for strain relief of the cable terminated to the field termination plug. As shown in FIGS. 28 to 30, the strain relief device 70 includes a receiving portion 71 and a securing portion 75. The receiving portion 71 is used for receiving a cable. The securing portion 75 extends from the receiving portion 71 and is utilized for detachably securing to a plug housing 20 of the field termination plug, as shown in FIGS. 5, 6, and 24. As shown in FIGS. 28 to 31, the receiving portion 71 has an inner end 711, an outer end 712, and a tapering hole 720 passing through the receiving portion 71 for retaining a cable. The tapering hole 720, as illustrated in FIGS. 28 to 31, has an inner opening 721 at the inner end 711 tapering to an outer opening 722 at the outer end 712. For example, the tapering hole 720 is in a shape of truncated cone. Referring to FIG. 31, the securing portion 75 has a cavity 750 communicating with the tapering hole 720 and extends from the inner end 711 of the receiving portion 71. As illustrated in FIGS. 28 to 31, the securing portion 75 has one or more securing elements 751, 752, 753, 754, for example, mating parts such as openings, are defined on top, bottom, left, right sides of the securing portion 75 so as to securing the field termination plug.

Figure 32:
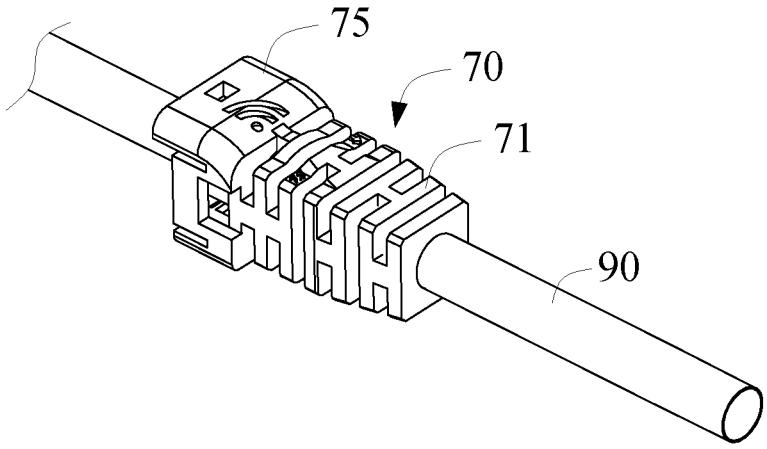
FIG. 32 is a perspective view illustrating the strain relief device of FIG. 28 without truncation to receive a cable of a first cable diameter, according to an embodiment of the disclosure.

In some embodiments, the receiving portion 71 is used for receiving a cable without truncation when a cable has a size smaller than or equal to that of the outer opening 722. As illustrated in FIG. 32, the receiving portion 71 receives a cable 90, which is a 26AWG stranded cable having an outer diameter of 5.8 mm, for example.

Figure 33:
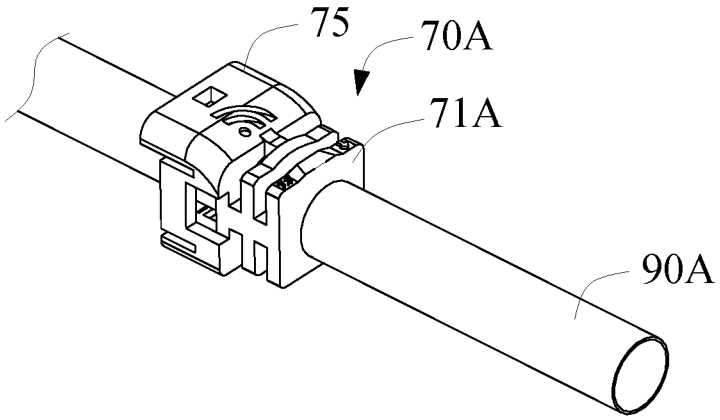
FIG. 33 is a perspective view illustrating the strain relief device of FIG. 28 with truncation to receive a cable of a second cable diameter, according to an embodiment of the disclosure.

In some embodiments, the receiving portion 71 is capable of being truncated to fit a cable when the cable has a size greater than that of the outer opening 722 and smaller than or equal to that of the inner opening 721. As illustrated in FIG. 33, the truncated receiving portion 71A resulted from the receiving portion 71 being truncated receives a cable 90A, which is a 23AWG solid cable having an outer diameter of 7.5 mm, for example.

Figure 34:
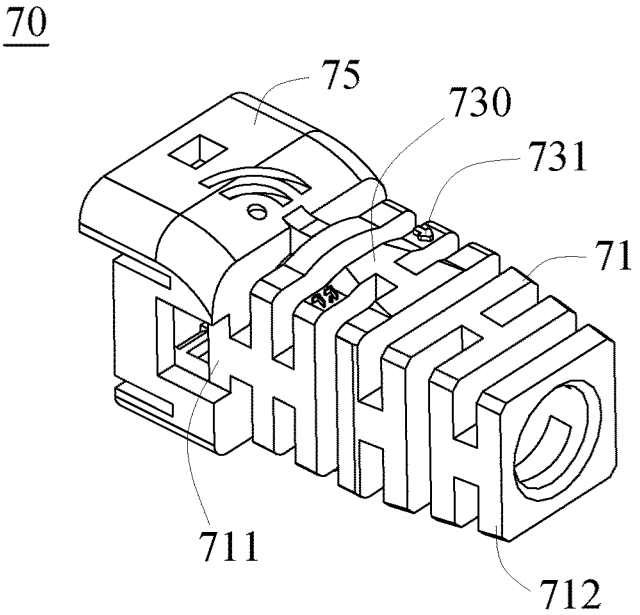
FIG. 34 is a perspective view illustrating the strain relief device of FIG. 28 with an indicator for truncation according to an embodiment of the disclosure.

Referring to FIG. 34, in an embodiment, the receiving portion 71 includes an outer surface 730, which is segmented, between the inner end 711 and the outer end 712; and an indicator 731 disposed on the outer surface 730 to indicate a position for truncation of the receiving portion 71 for a specific cable size. For example, the indicator 731 is disposed for indicating a position for truncation of the receiving portion 71 for a 23AWG solid cable, and a technician may truncate the indicator 731 by way of the indicator 731 efficiently.

For example, when the field termination plug is deployed in a zone cabling, a cable of a bigger outer diameter may be employed. In this case, the receiving portion 71 can be cut off at the indicator 731, as indicated. Then, the truncated strain relief device 70A is capable of receiving the cable, as shown in FIG. 33. If field termination plug is used in a data center or telecommunication room, in most cases, a cable of a smaller outer diameter may be employed. In this scenario, the strain relief device 70 without truncation will fit the cable, as shown in FIG. 32.

In addition, the receiving portion 71 may include a plurality of indicators on the outer surface 730 so as to indicate positions for truncation of the receiving portion 71 for different specific cable sizes. The indicator is optional and the disclosure is not limited to the above examples. In other embodiments, the strain relief device 70 may be configured without the indicator.

Figure 35:
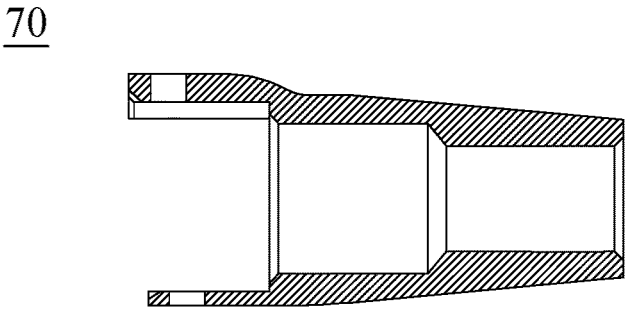
FIG. 35 illustrates another embodiment of a tapering hole of a receiving portion.
Figure 36:
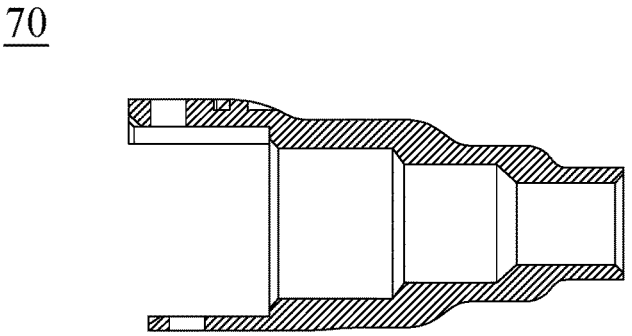
FIG. 36 illustrates yet another embodiment of a tapering hole of a receiving portion.

As illustrated in FIGS. 28 to 30, the receiving portion 71 may be constructed by a series of ridges or segments with the tapering hole 720 defined inside the receiving portion 71. The tapering hole 720 may be in the shape of a truncated cone, as illustrated in FIG. 31. In some embodiments, the tapering hole 720 of the receiving portion 71 may be in a stepwise tapering shape, as illustrated in FIGS. 35 and 36. The tapering hole 720 may also be in any other smoothly tapering shape. In some embodiments, the outer surface 730 of the receiving portion 71, in addition to a segmented one shown in FIG. 28, may be configured in a smoothly tapering shape as shown in FIG. 35, a stepwise tapering shape as shown in FIG. 36, or any other appropriate shape. The implementation of the disclosure is not limited to the above examples.

In some embodiments, male and female parts (e.g., protrusions and openings) or any mating parts may be implemented on the strain relief device 70 and on one or both of the plug housing 20 and the cover 50 for engagement and securing.

Figure 37:
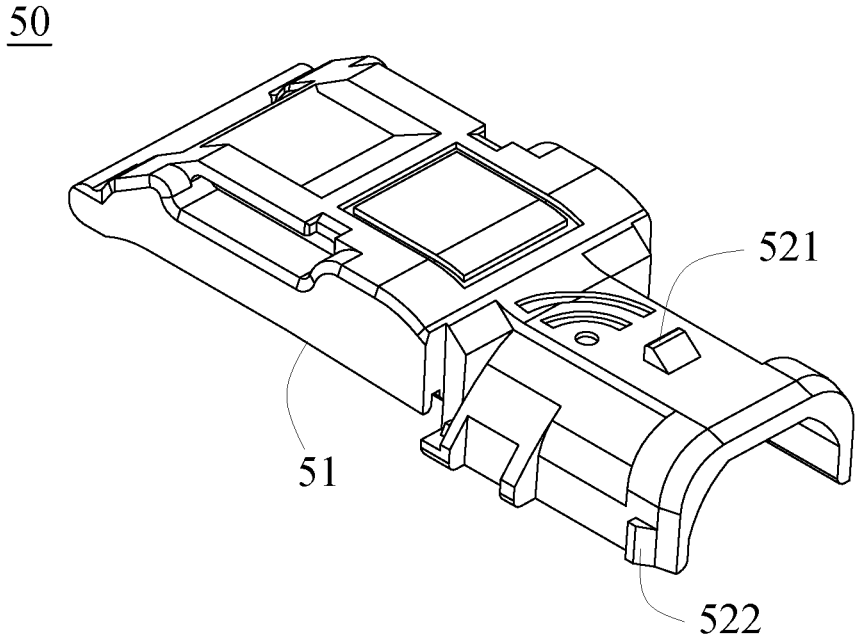
FIG. 37 is a perspective view illustrating a cover for the field termination plug according to an embodiment of the disclosure.
Figure 38:
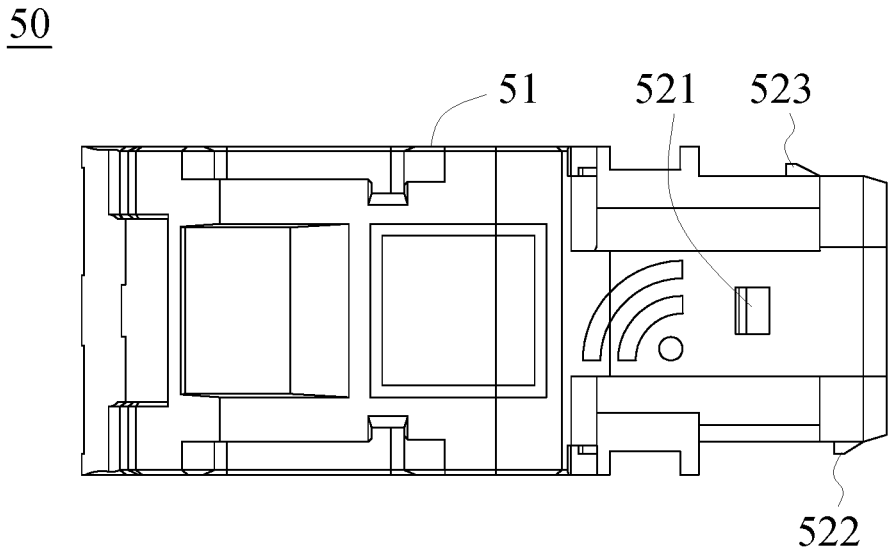
FIG. 38 is a top view illustrating the cover of FIG. 37.

In some embodiments, the cover 50 may further include engaging elements for engagement and securing with the strain relief device 70. For example, the cover 50 may further include one or more engaging elements, such as 521, 522, 523, disposed near the outer surface of the cover 50, as illustrated in FIGS. 37 and 38.

Figure 39:
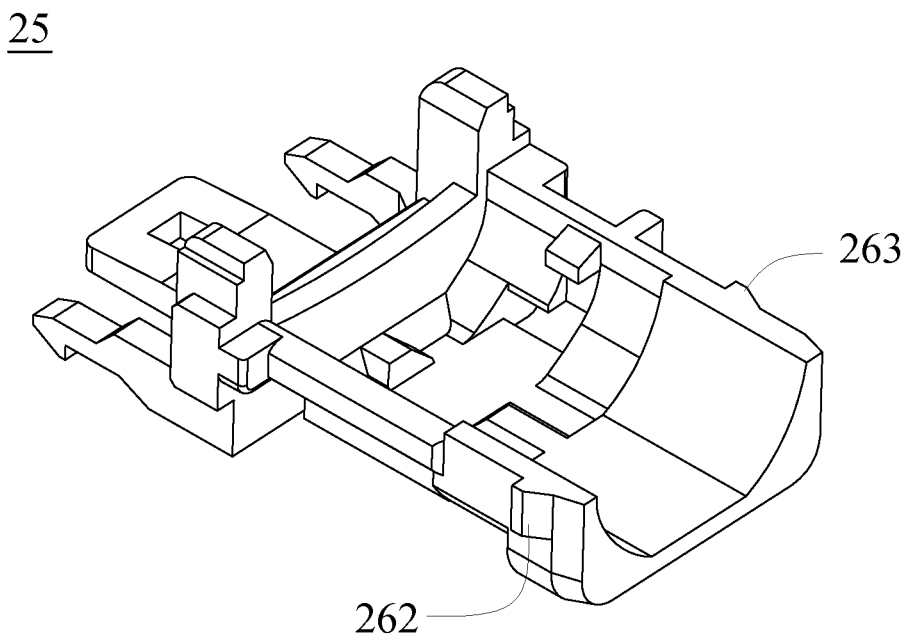
FIG. 39 is a perspective view illustrating a rear housing for the field termination plug according to an embodiment of the disclosure.
Figure 40:
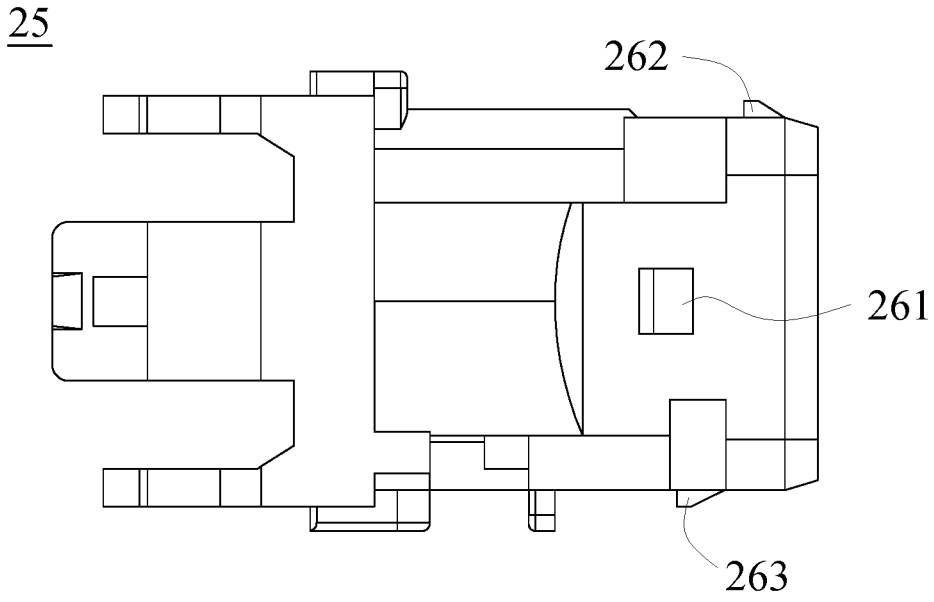
FIG. 40 is a bottom view illustrating the rear housing of FIG. 39.

In some embodiments, the plug housing 20, such as the rear housing 25, may further include engaging elements for engagement and securing with the strain relief device 70. For example, the rear housing 25 may further include one or more engaging elements, such as 261, 262, 263, as illustrated in FIGS. 39 and 40.

In some embodiments, the securing portion 75 may include a plurality of securing elements for detachably securing to one or both of the rear housing 25 and the cover 50 when the cover 50 is in the closed position, as shown in FIGS. 3, 4, 26 and 27. For examples, the securing elements 751, 752, 753, 754, as illustrated in FIGS. 28 to 31, are capable of securing to the cover 50 and the rear housing 25, as illustrated in FIGS. 37 to 40. The implementation of the disclosure is not limited to the above examples. In some embodiments, male and female parts (e.g., protrusions and openings) or any mating parts may be implemented on the strain relief device 70 and on one or both of the plug housing 20 and the cover 50 for engagement and securing.

Hence as illustrated above, the strain relief device 70 is capable of being a cable gland in addition to releasing stress and capable of receiving cables with different cable sizes.

Figure 41:
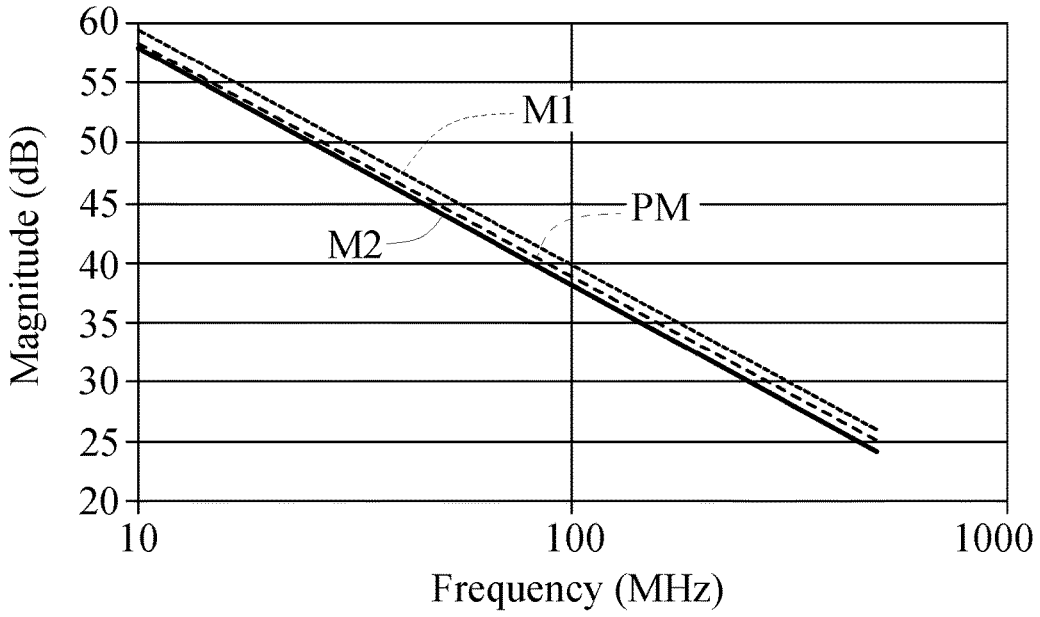
FIG. 41 is a graph of magnitude performance of a field termination plug according to an embodiment of the invention.

In an example, referring to FIG. 41, a graph illustrates magnitude performance of a field termination plug according to an embodiment, as in FIG. 4, with piercing terminals disposed in groups, as exemplified in FIG. 11, by way of measurement of the field termination plug over a frequency range less than 1000 MHz. In FIG. 41, curves M1 and M2 indicate an upper limit and a lower unit of magnitude requirement by a standard, e.g., ANSI/TIA-568-C.2. A curve PM indicating the magnitude of the field termination plug lies between the curves M1 and M2 over the frequency range, as can be observed in FIG. 41.

Figure 42:
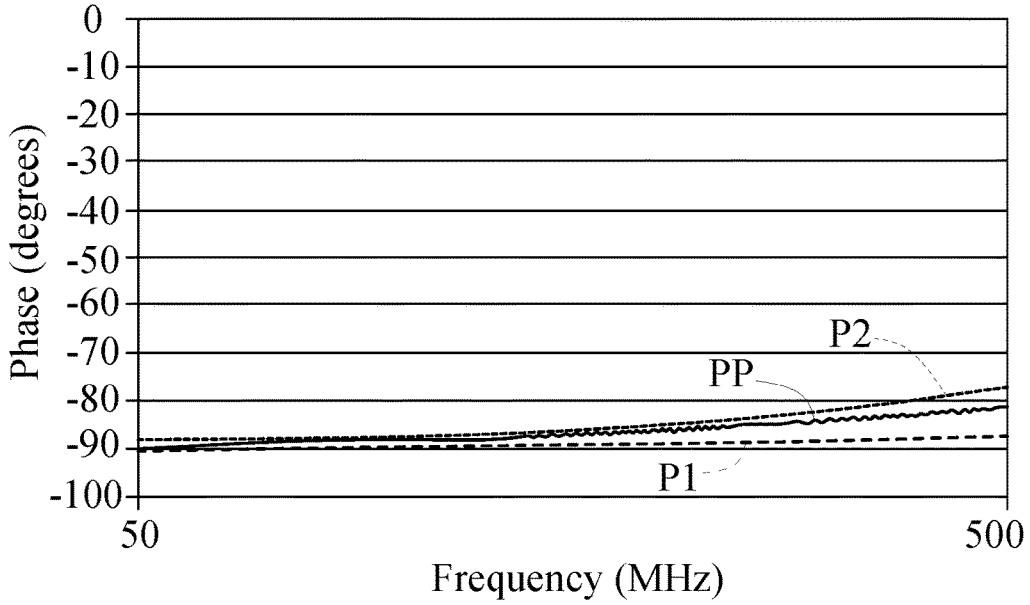
FIG. 42 is a graph of phase performance of a field termination plug according to an embodiment of the invention.

In another example, referring to FIG. 42, a graph illustrates phase performance of the field termination plug mentioned in the above example for FIG. 42, by way of measurement of the field termination plug over a frequency range between 50 to 500 MHz. In FIG. 42, curves P1 and P2 indicate an upper limit and a lower unit of phase requirement by a standard, e.g., ANSI/TIA-568-C.2. As can be observed in FIG. 42, a curve PP indicating the phase of the field termination plug lies between the curves P1 and P2 over the frequency range.

With reference to FIGS. 41 and 42, it shows that the field termination plug according to an embodiment of the invention with piercing terminal disposed in groups adjacent to lateral sides and an inner side is capable of contributing to the magnitude and phase performance fulfilling the requirement of the standard. However, the implementation of the invention is not limited thereto.

While certain embodiments have been described and shown in the accompanying drawings, it is to be understood that such embodiments are merely illustrative of and not restrictive on the broad disclosure, and that the disclosure is not limited to the specific constructions and arrangements shown and described, since numerous modifications and variations could be made thereto by those skilled in the art without departing from the scope and spirit of the invention set forth in the claims.

What is claimed is:

1. A field termination plug for termination of a plurality of wires of a cable and connection to a network jack, the field termination plug comprising:

a contact retainer;

a plug housing including a front portion having a first opening for attachment of the contact retainer to the front portion; and an accommodation portion having a second opening;

a terminal connection unit including a plurality of contacts, a plurality of piercing terminals electrically coupled to the respective contacts, and two opposite lateral sides and an inner side perpendicular to the two lateral sides, wherein when the terminal connection unit is carried by the plug housing and the contact retainer is attached to the front portion, the contacts are disposed on the front portion for electrical coupling to the network jack and the piercing terminals are disposed upward on the accommodation portion, the piercing terminals including a first group of piercing terminals disposed adjacent to the inner side, a second group of piercing terminals disposed adjacent to one of the lateral sides, and a third group of piercing terminals disposed adjacent to another one of the lateral sides; and a cover, pivotally connectable to the plug housing, wherein when the cover is pivoted to an open position, the piercing terminals of the terminal connection unit carried by the plug housing are exposed in the second opening in order for a wire organizer for attachment of the wires to be disposed on the piercing terminals; when the cover is pivoted to a closed position, the cover presses the wire organizer such that the wires attached to the wire organizer are terminated to the respective piercing terminals.

2. The field termination plug according to claim 1, wherein the terminal connection unit includes:

an insulation base;

a circuit board, disposed on the insulation base, wherein the contacts and the piercing terminals are disposed on the circuit board; and a terminal connection housing for covering the circuit board partially, wherein the first guiding element is disposed on the terminal connection housing and the terminal connection housing has openings through which the piercing terminals are exposed at least partially.

3. The field termination plug according to claim 2, wherein the insulation base has a securing arm which is resilient and for engaging with the front housing.

4. The field termination plug according to claim 1, wherein the first group of piercing terminals are capable of terminating four of the wires, the second group of piercing terminals are capable of terminating another two of the wires, and the third group of piercing terminals are capable of terminating yet another two of the wires.

5. The field termination plug according to claim 4, wherein the terminal connection unit further has a first guiding element disposed between the contacts and the first group of piercing terminals.

6. The field termination plug according to claim 5, wherein the first guiding element has a top section; the front portion of the plug housing has a bearing section; the bearing section and the top section form a bearing for pivotal connection between the cover and the plug housing when the terminal connection unit is carried by the plug housing.

7. The field termination plug according to claim 5, wherein the field termination plug further includes the wire organizer and the wire organizer has a plurality of wire-receiving slots for attachment of the wires and a second guiding element for engaging with the first guiding element.

8. The field termination plug according to claim 1, wherein the cover includes:

a protection portion having a plurality of lateral sides and a plurality of grooves along the lateral sides; and a pivot section, extending from the protection portion, for being pivotally engaged with the plug housing.

9. The field termination plug according to claim 8, further comprising:

a detachable latch for detachably engaging with the grooves and for moving along a traveling path defined by the grooves when the cover is pivoted from the closed position to the open position, the detachable latch including a front arm, engaging arms for engaging with the grooves, and a rear member extending from the front arm and the engaging arms.

10. The field termination plug according to claim 9, wherein the contact retainer further has a plug lever; and the front arm is used for depressing the plug lever when the front arm is pivoted toward the plug lever with respect to the engaging arms, while the cover is in the closed position and the detachable latch is positioned at a first end of the traveling path.

11. The field termination plug according to claim 10, wherein the detachable latch is capable of being detached from the cover when the detachable latch is positioned at a second end of the traveling path so as to prevent depression of the plug lever as the field termination plug being connected to the network jack.

12. The field termination plug according to claim 1, further comprising:

a strain relief device including:

a receiving portion for receiving the cable; and a securing portion, extending from the receiving portion, for detachably securing to the plug housing and the cover when the cover is in the closed position.

13. The field termination plug according to claim 12, wherein the plug housing includes:

a front housing including the front portion and the accommodation portion; and a rear housing for being attached to the front housing so as to cover at least one side of the terminal connection unit carried by the front housing;

wherein the securing portion includes a plurality of securing elements for detachably securing to the rear housing and the cover when the cover is in the closed position.

14. The field termination plug according to claim 12, wherein the receiving portion has a tapering hole passing through the receiving portion for retaining the cable, the receiving portion includes an inner end and an outer end, the tapering hole has an inner opening at the inner end tapering to an outer opening at the outer end, wherein the securing portion extends from the inner end of the receiving portion.

15. The field termination plug according to claim 14, wherein the receiving portion is used for receiving the cable without truncation when the cable has a size smaller than or equal to that of the outer opening.

16. The field termination plug according to claim 15, wherein the receiving portion is capable of being truncated to fit the cable when the cable has a size greater than that of the outer opening and smaller than or equal to that of the inner opening.

17. The field termination plug according to claim 16, wherein the receiving portion includes: an outer surface between the inner end and the outer end; and an indicator disposed on the outer surface to indicate a position for truncation of the receiving portion for a specific cable size.

* * * * *